US008133006B2

(12) United States Patent
Yoshida

(10) Patent No.: US 8,133,006 B2
(45) Date of Patent: Mar. 13, 2012

(54) AXIAL FLOW FAN UNIT

(75) Inventor: Yusuke Yoshida, Kyoto (JP)

(73) Assignee: Nidec Corporation, Kyoto (JP)

( * ) Notice: Subject to any disclaimer, the term of this patent is extended or adjusted under 35 U.S.C. 154(b) by 526 days.

(21) Appl. No.: 12/392,243

(22) Filed: Feb. 25, 2009

(65) Prior Publication Data

US 2009/0214336 A1 Aug. 27, 2009

(30) Foreign Application Priority Data

Feb. 26, 2008 (JP) ..... 2008-044109

(51) Int. Cl.
*F01D 1/25* (2006.01)

(52) U.S. Cl. ..... 415/68

(58) Field of Classification Search ..... 415/68, 415/193, 199.5; 416/198 R, 128; 417/360
See application file for complete search history.

(56) References Cited

U.S. PATENT DOCUMENTS 6,540,479 B2 * 4/2003 Liao et al. ..... 415/199.5
6,612,817 B2 * 9/2003 Lin et al. ..... 417/423.5
6,827,549 B1 12/2004 Horng et al.
7,156,611 B2 * 1/2007 Oosawa et al. ..... 415/68
2005/0106026 A1 5/2005 Oosawa et al.
2007/0003413 A1 1/2007 Hsu et al.

FOREIGN PATENT DOCUMENTS

JP 2004-278370 A 10/2004
JP 2004-278371 A 10/2004

OTHER PUBLICATIONS

Yoshida et al.; "Axial Flow Fan Unit"; U.S. Appl. No. 12/392,248, filed Feb. 25, 2009.

* cited by examiner

*Primary Examiner* — Alexander Gilman
(74) *Attorney, Agent, or Firm* — Keating & Bennett, LLP

(57) ABSTRACT

A frame for a serially connected axial flow fan unit includes a first housing and a second housing coupled together. The first housing includes a first axial locking mechanism and a first unlocking mechanism, and the second housing includes a second axial locking mechanism and a second unlocking mechanism. The first and the second axial locking mechanism are locked against each other through their movement along their axis. The first and the second unlocking mechanism unlock the first and the second housing with a twisting force equal to or greater than a predetermined value when the first and the second housing are twisted relative to each other. When the first and the second end portion are brought into contact, the first and the second axial locking mechanism are locked against each other and the first and the second unlocking mechanism engage with each other.

20 Claims, 21 Drawing Sheets

AXIAL FLOW FAN UNIT

BACKGROUND OF THE INVENTION

1. Field of Invention

The present invention relates to a serially connected axial flow fan unit.

2. Description of the Related Art

Conventionally, a cooling fan is installed inside a housing of various kinds of electronic devices to cool electronic parts thereof. As the electronic parts suffer from increased heat generation attendant with high performance and have an increased arrangement density attributable to the reduction in size of the housing, there is a need to increase the static pressure and flow rate of the cooling fan. To meet this need, a serially connected axial flow fan unit has been used as a cooling fan that can secure a large enough static pressure and an increased flow rate. The serially connected axial flow fan unit includes a plurality of axial flow fans serially connected to one another by many different methods.

In a case where the axial flow fans are coupled together by screws, rivets or the like, there is a need to form through-holes in the housings of the axial flow fans, in addition to the through-holes used in attaching the axial flow fan unit to a device. With this structure, it is difficult to re-attach the axial flow fans even though the combination of axial flow fans may be changed during the course of designing or installing the serially connected axial flow fan unit.

Once the axial flow fans are connected to one another, it is difficult to detach them without causing damage to the through-holes or the housings. Therefore, even if the combination of axial flow fans is changed during the course of designing or installing the serially connected axial flow fan unit, it is impossible to re-attach the axial flow fans without reducing the connection strength thereof.

SUMMARY OF THE INVENTION

In order to overcome the problems described above, preferred embodiments of the present invention provide a frame for a serially connected axial flow fan unit, including a first housing and a second housing coupled together, wherein the first housing includes at a first end portion thereof a first axial locking mechanism and a first unlocking mechanism, the second housing includes at a second end portion thereof a second axial locking mechanism mating with the first axial locking mechanism and a second unlocking mechanism mating with the first unlocking mechanism, the first axial locking mechanism and the second axial locking mechanism are configured to be locked against each other through their movement along an axis of the axial flow fan unit, the first unlocking mechanism and the second unlocking mechanism are configured to unlock the first housing and the second housing with a twisting force equal to or greater than a predetermined value when the first housing and the second housing are twisted relative to each other in a specified direction, and when the first end portion and the second end portion are brought into contact with each other, the first axial locking mechanism and the second axial locking mechanism are locked against each other and the first unlocking mechanism and the second unlocking mechanism engage with each other.

Further, preferred embodiments of the present invention also provide a serially connected axial flow fan unit including a first axial flow fan including a first impeller and a first housing, and a second axial flow fan including a second impeller and a second housing, wherein the first housing has at a first end portion thereof a first axial locking mechanism and a first unlocking mechanism, the second housing has at a second end portion thereof a second axial locking mechanism mating with the first axial locking mechanism and a second unlocking mechanism mating with the first unlocking mechanism, the first axial locking mechanism and the second axial locking mechanism are configured to be locked against each other through their movement along an axis of the axial flow fan unit, the first unlocking mechanism and the second unlocking mechanism are configured to unlock the first housing and the second housing with a twisting force equal to or greater than a predetermined value when the first housing and the second housing are twisted relative to each other in a specified direction, and when the first end portion and the second end portion are brought into contact with each other, the first axial locking mechanism and the second axial locking mechanism are locked against each other and the first unlocking mechanism and the second unlocking mechanism engage with each other.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
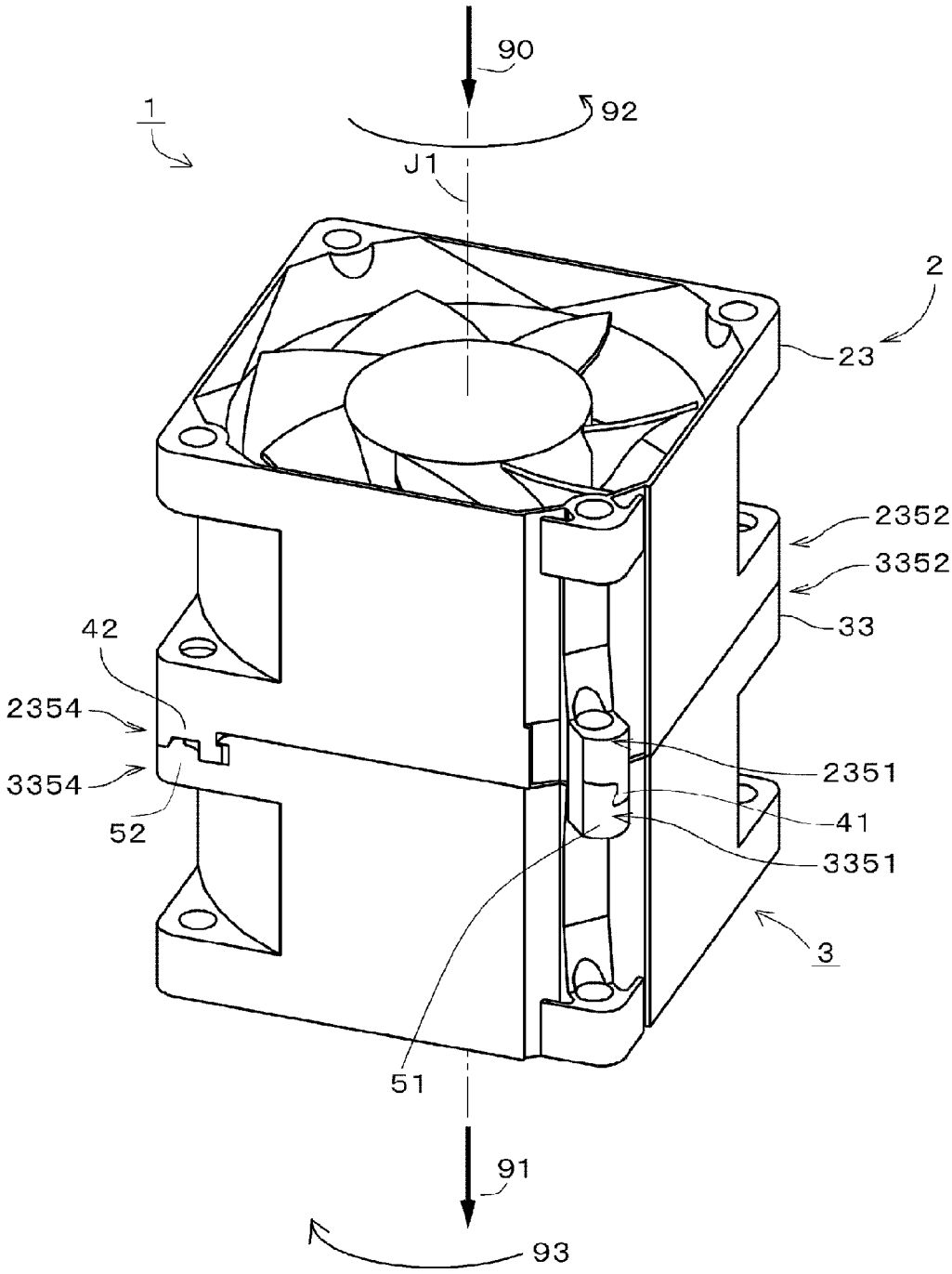
FIG. 1 is a perspective view showing a serially connected axial flow fan unit in accordance with a first preferred embodiment of the present invention.

Referring to FIGS. 1 through 21, preferred embodiments of the present invention will be described in detail. It should be noted that in the explanation of the preferred embodiments of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction parallel or substantially parallel to a rotation axis, and a radial direction indicates a direction perpendicular or substantially perpendicular to the rotation axis.

First Preferred Embodiment

Serially Connected Axial Flow Fan Unit

FIG. 1 is a perspective view showing a serially connected axial flow fan unit 1 in accordance with a first preferred embodiment of the present invention. The axial flow fan unit 1 includes a first axial flow fan 2 and a second axial flow fan 3 arranged below the first axial flow fan 2 along an axis J1. The first and second axial flow fans 2 and 3 are provided with first and second housings 23 and 33, respectively, which define a frame of the axial flow fan unit 1. The frame has a hollow structure. Air is admitted into the frame in the direction indicated by an upper arrow 90 in FIG. 1 and then discharged in the direction indicated by a lower arrow 91.

Figure 2:
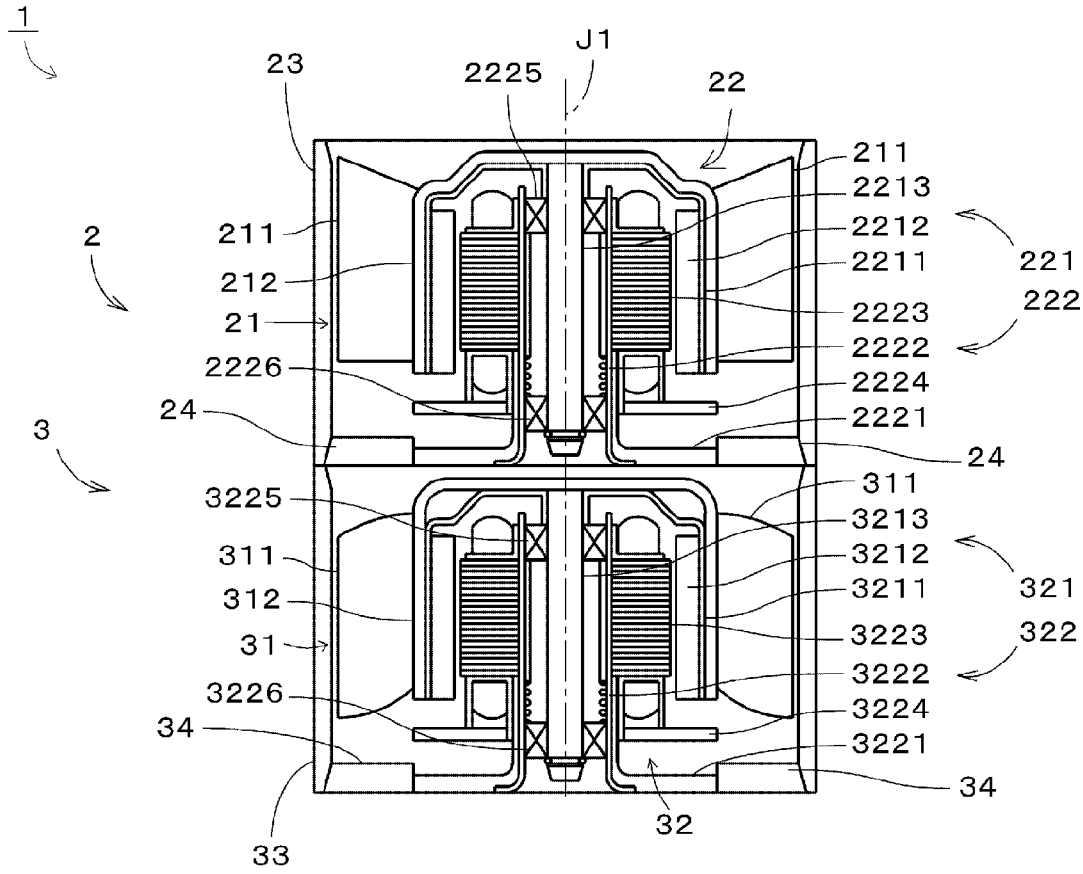
FIG. 2 is a section view of the serially connected axial flow fan unit in accordance with the first preferred embodiment of the present invention.

FIG. 2 is a vertical section view of the serially connected axial flow fan unit 1 taken along a plane containing the axis J1. The axial flow fan unit 1 preferably is a so-called double contra-rotating axial flow fan unit. The rotating direction of a first impeller 21 of the first axial flow fan 2 is opposite the rotating direction of a second impeller 31 of the second axial flow fan 3.

First Axial Flow Fan

Preferably, the first axial flow fan 2 includes a first impeller 21, a first motor 22, a first housing 23 and a plurality of first support ribs 24. The first impeller 21 is rotated about the axis J1 by the first motor 22. The first housing 23 has a substantially cylindrical inner surface and is arranged to surround the outer circumference of the first impeller 21. The first support ribs 24 are designed to support the first motor 22 and interconnect the first housing 23 and the first motor 22. The first housing 23 and the first support ribs 24 are preferably formed of injection-molded resin into a single piece.

The first impeller 21 is preferably provided with a substantially cylindrical closed-top cup 212 and a plurality of first blades 211. The cup 212 covers the outer circumference of the first motor 22. The first blades 211 are provided on the outer surface of the cup 212 at a uniform interval in the circumferential direction. Each of the first blades 211 extends radially outwards. The first motor 22 is preferably provided with a first rotor portion 221 and a first stator portion 222.

The first rotor portion 221 is preferably provided with a metal yoke 2211, a field magnet 2212, and a shaft 2213. The yoke 2211 has a substantially cylindrical closed-top shape. The field magnet 2212 has a substantially cylindrical shape and is fixed to the inner surface of the yoke 2211. The shaft 2213 is fixed at one end to a substantially central region of a cover portion of the yoke 2211. The yoke 2211 is clad with the cup 212, as a result of which the first rotor portion 221 is formed into a single piece with the first impeller 21.

The first stator portion 222 is preferably provided with a base portion 2221, a bearing holder portion 2222, an armature 2223, and a circuit board 2224. The base portion 2221 has a substantially disk-like shape with an opening provided at a substantially central region thereof. The bearing holder portion 2222 has a substantially cylindrical shape and protrudes upwards from the base portion 2221. The armature 2223 is attached to the outer circumference of the bearing holder portion 2222 and is electrically connected to the circuit board 2224 arranged below the armature 2223.

The base portion 2221 is fixed to the substantially cylindrical inner surface of the first housing 23 through the first support ribs 24 to thereby hold the respective portions of the first stator portion 222 in place. The armature 2223 is radially opposite the field magnet 2212 so that torque acting about the axis J1 can be generated between the armature 2223 and the field magnet 2212. Ball bearings 2225 and 2226 are arranged inside the bearing holder portion 2222 at upper and lower positions along the axis J1 to rotatably support the shaft 2213 inserted into the bearing holder portion 2222.

Second Axial Flow Fan

The second axial flow fan 3 has substantially the same structure as that of the first axial flow fan 2 and, preferably, includes a second impeller 31, a second motor 32, a second housing 33, and a plurality of second support ribs 34. The second impeller 31 has a plurality of second blades 311 arranged at a uniform interval and in a reverse pitch with respect the first impeller 21.

In the axial flow fan unit 1, the first motor 22 rotates the first impeller 21 to generate an air stream flowing along the axis J1. The second motor 32 rotates the second impeller 31 in the reverse direction to the rotating direction of the first motor 22, thereby generating an air stream flowing in the same direction as the flowing direction of the air stream caused by the first impeller 21. This makes it possible for the axial flow fan unit 1 to secure a large enough air flow rate and an increased static pressure.

Housings

Figure 3:
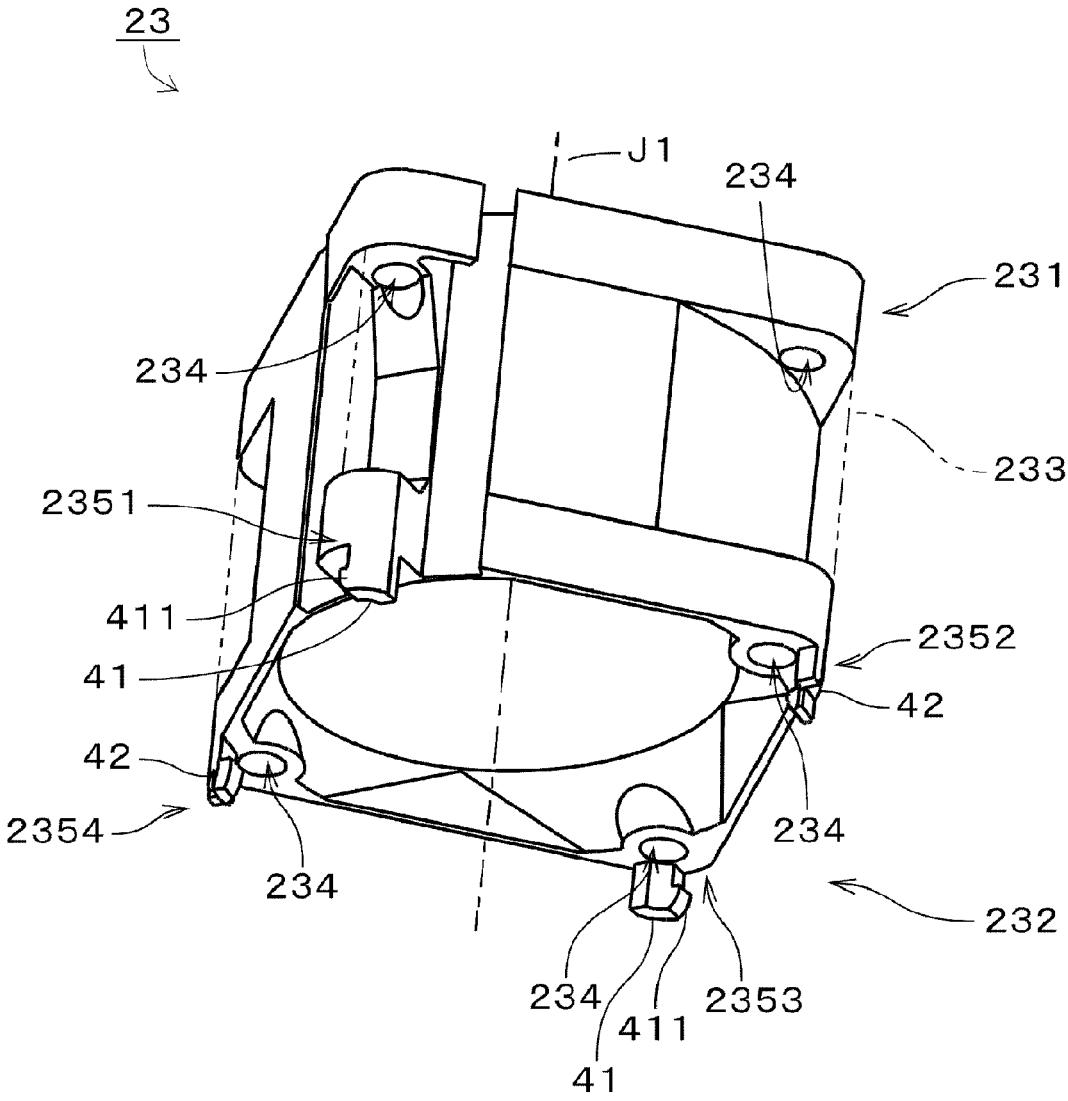
FIG. 3 is a perspective view showing a first housing included in the axial flow fan unit of the first preferred embodiment of the present invention.
Figure 4:
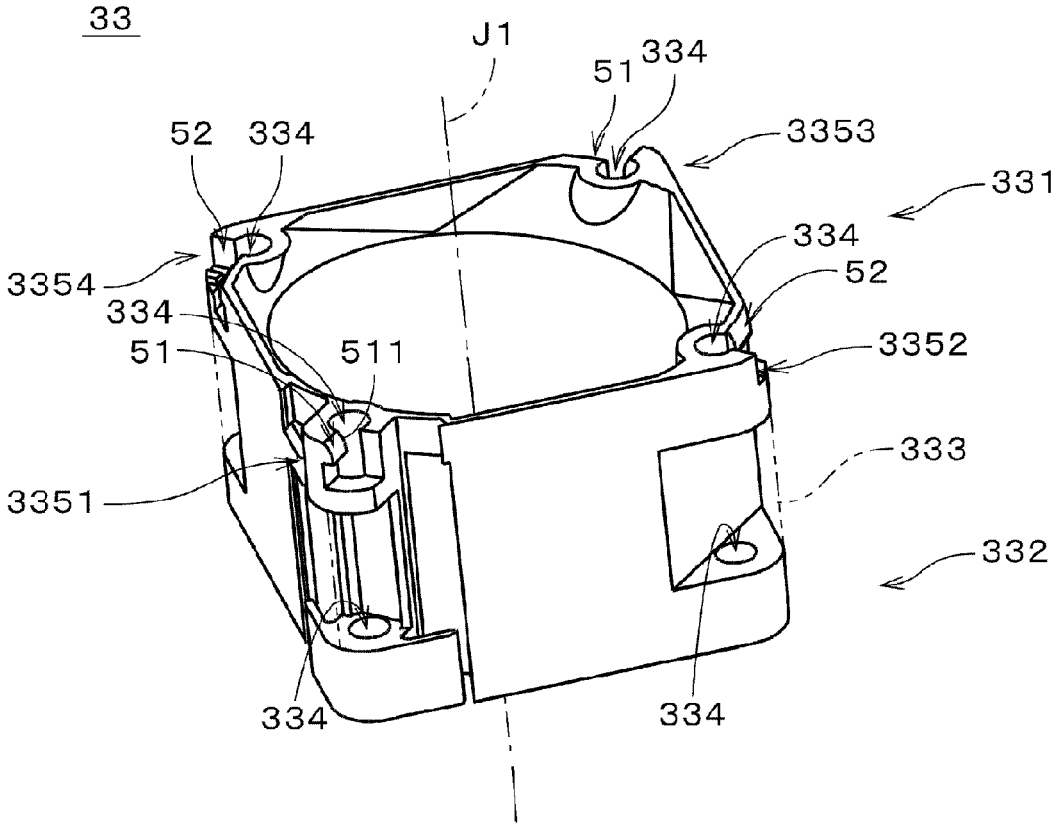
FIG. 4 is a perspective view showing a second housing included in the axial flow fan unit of the first preferred embodiment of the present invention.

FIGS. 3 and 4 are perspective views showing the first housing 23 and the second housing 33, respectively. In FIGS. 3 and 4, the first housing 23 and the second housing 33 are depicted in such a fashion as to show a lower end portion 232 of the first housing 23 and an upper end portion 331 of the second housing 33, both of which will come into contact with each other when fabricating the axial flow fan unit 1.

Referring to FIG. 3, the first housing 23 includes an upper end portion 231 and a lower end portion 232 each having a flange-like shape extending outwards in a perpendicular or substantially perpendicular relationship with the axis J1. When seen in a plan view, each of the upper and lower end portions 231 and 232 has a substantially square contour. The contour lines 233 (indicated by double-dotted chain lines) axially interconnecting the contours of the upper and lower end portions 231 and 232 define a substantially rectangular imaginary column. The upper end portion 231 has four corner portions and the lower end portion 232 has four corner portions 2351 to 2354. Through-holes 234 are provided in the respective corner portions of the upper and lower end portions 231 and 232. Screws, rivets or the like will be inserted into the through-holes 234 in the event that the axial flow fan unit 1 is mounted to a specified device.

Referring to FIG. 4, the second housing 33 includes an upper end portion 331 and a lower end portion 332 each having a flange-like shape. When seen in a plan view, each of the upper and lower end portions 331 and 332 has a substantially square contour. The contour lines 333 (indicated by double-dotted chain lines) axially interconnecting the contours of the upper and lower end portions 331 and 332 define a substantially rectangular imaginary column. The upper end portion 331 has four corner portions 3351 to 3354 and the lower end portion 332 has four corner portions. As in the first housing 23, through-holes 334 are provided in the respective corner portions of the upper and lower end portions 331 and 332.

Locking Portions

As can be seen in FIG. 3, first axial locking portions 41 each protruding toward the upper end portion 331 of the second housing 33 are provided in the corner portions 2351 and 2353 of the lower end portion 232 opposite each other with respect to the axis J1.

First combination locking portions 42, each of which includes a third axial locking mechanism and a first unlocking mechanism, are provided in the corner portions 2352 and 2354 of the lower end portion 232 opposite each other with respect to the axis J1.

The first combination locking portions 42 protrude toward the upper end portion 331 of the second housing 33. The first preferred embodiment is directed to an example in which the axial locking portions and the combination locking portions define a locking mechanism.

The first axial locking portions 41 and the first combination locking portions 42 are arranged not to extend outside of the flange-like regions of the corner portions 2351, 2352, 2353 and 2354 but to extend along the contour lines 233. In other words, the first axial locking portions 41 and the first combination locking portions 42 have such a shape so as not to affect the size of a wind tunnel portion defined inside the first housing 23. This ensures that the wind tunnel portion of the first housing 23 has an increased size.

Referring to FIG. 4, second axial locking portions 51 are provided in the corner portions 3351 and 3353 of the upper end portion 331 opposite each other with respect to the axis J1. The second axial locking portions 51 are made into a recessed shape by cutting away the corner portions 3351 and 3353. Second combination locking portions 52, each of which includes a fourth axial locking mechanism and a second unlocking mechanism, are provided in the corner portions 3352 and 3354 of the upper end portion 331 opposite each other with respect to the axis J1. The second combination locking portions 52 are made into a recessed shape by cutting away the corner portions 3352 and 3354.

The second axial locking portions 51 and the second combination locking portions 52 preferably extend parallel or substantially parallel to the axis J1 along the outer surfaces of the corner portions from the end surface opposite the first housing 23. In other words, the second axial locking portions 51 and the second combination locking portions 52 extend along the contour lines 333. The second axial locking portions 51 and the second combination locking portions 52 have such a shape as not to affect the size of a wind tunnel portion defined inside the second housing 33. This ensures that the wind tunnel portion of the second housing 33 has an increased size.

When the first housing 23 and the second housing 33 are coupled together as shown in FIG. 1, the first axial locking portions 41 and the first combination locking portions 42 of the first housing 23 are fitted to the second axial locking portions 51 and the second combination locking portions 52 of the second housing 33, respectively.

This provides the below-mentioned locking mechanisms between the first axial locking portions 41 and the second axial locking portions 51 and between the first combination locking portions 42 and the second combination locking portions 52. Thus, the first axial flow fan 2 and the second axial flow fan 3 are connected to each other in a detachable manner.

Axial Locking Portions

Figure 5:
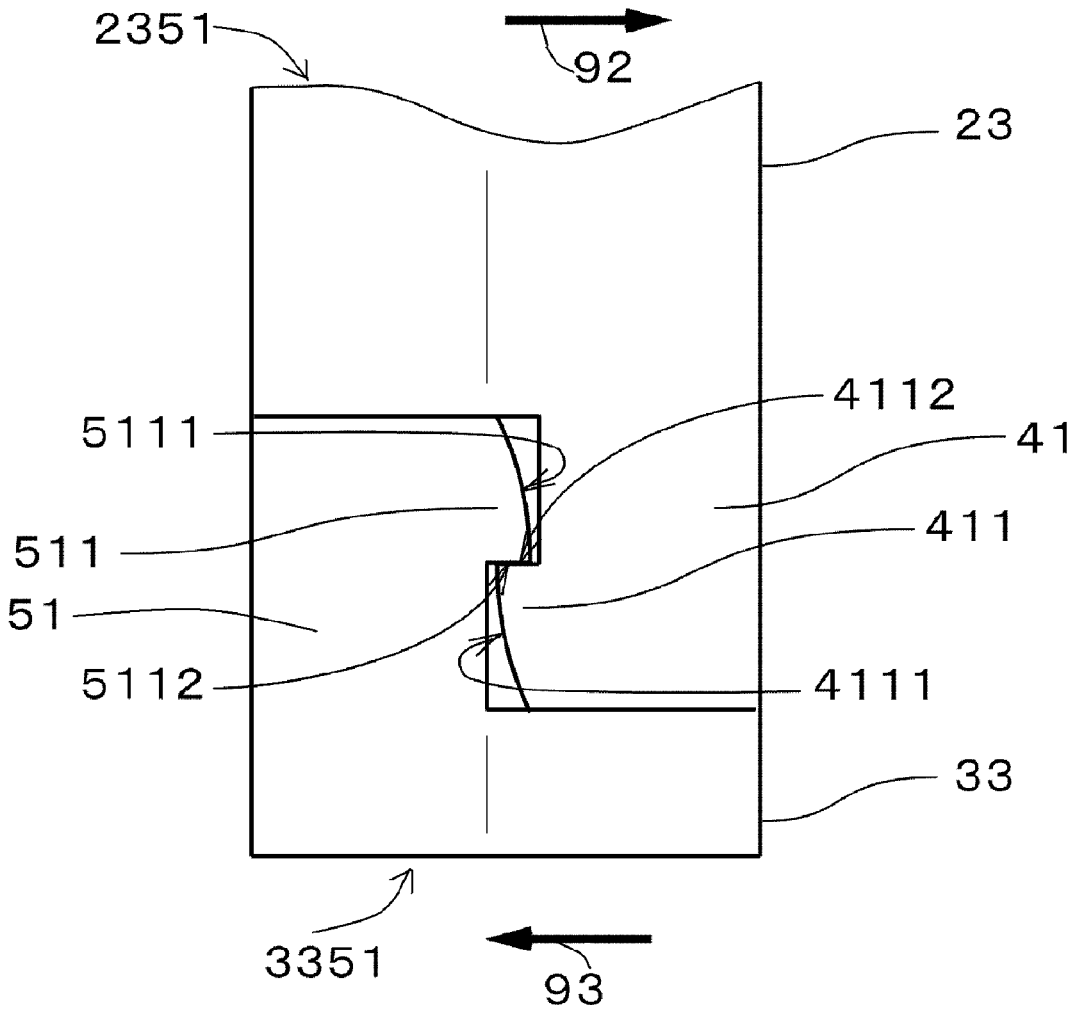
FIG. 5 is an enlarged view showing axial locking portions included in the axial flow fan unit of the first preferred embodiment of the present invention.

FIG. 5 is an enlarged view showing the corner portions 2351 and 3351 of the first housing 23 and the second housing 33 of the axial flow fan unit 1. As shown in FIGS. 3 and 5, a first axial locking piece 411 protrudes from the tip end of each of the first axial locking portions 41. As is apparent in FIG. 5, the first axial locking piece 411 has a slanting surface 4111 and an upper surface 4112 perpendicular or substantially perpendicular to the axis J1.

Referring to FIGS. 4 and 5, a second axial locking piece 511 is provided in each of the second axial locking portions 51 to protrude from the upper end of a side surface of the second axial locking portions 51. The second axial locking piece 511 has a slanting surface 5111 and a lower surface 5112 perpendicular or substantially perpendicular to the axis J1.

When the first axial locking portions 41 and the second axial locking portions 51 are fitted to each other as shown in FIG. 5, the first axial locking piece 411 and the second axial locking piece 511 are locked together and the upper surface 4112 and the lower surface 5112 come into contact with each other. This prevents the first housing 23 and the second housing 33 from moving relative to each other along the axis J1 (namely, from being separated from each other).

The same locking principle holds true in the corner portions 2353 and 3353 shown in FIGS. 3 and 4. When the first axial locking portions 41 and the second axial locking portions 51 are fitted to each other, the first axial locking piece 411 and the second axial locking piece 511 are locked together and the upper surface 4112 and the lower surface 5112 come into contact with each other.

Combination Locking Portions

Figure 6:
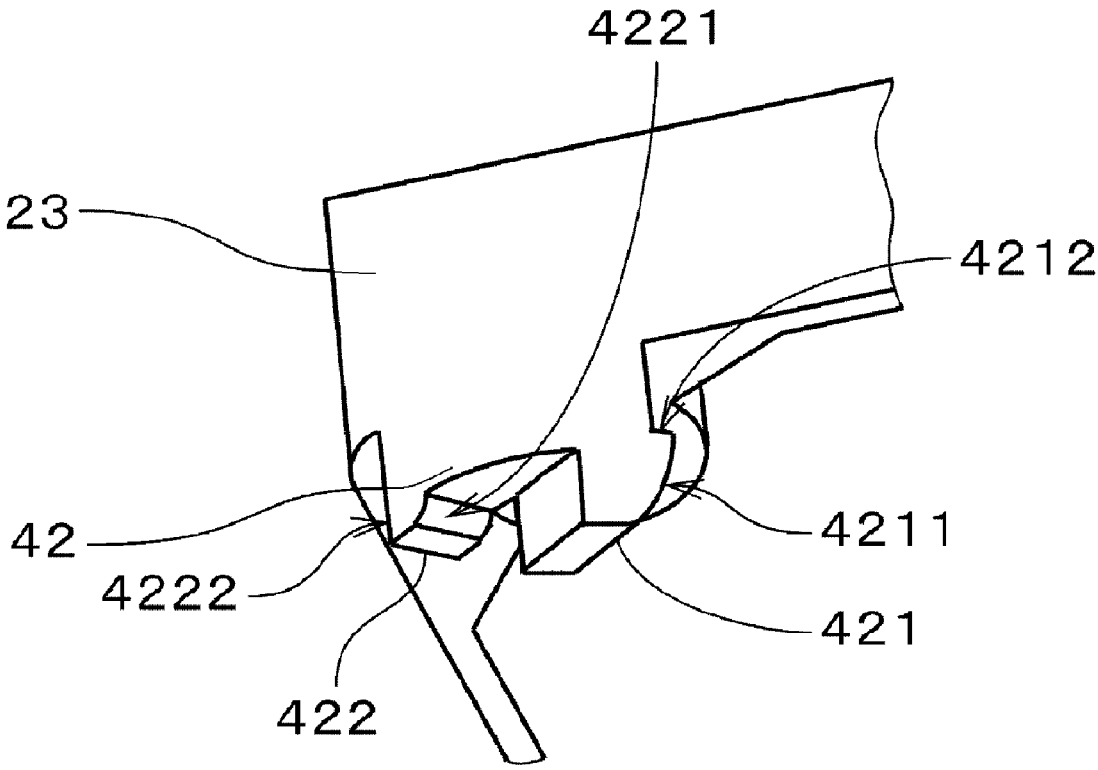
FIG. 6 is an enlarged view showing a combination locking portion of the first housing included in the axial flow fan unit of the first preferred embodiment of the present invention.
Figure 7:
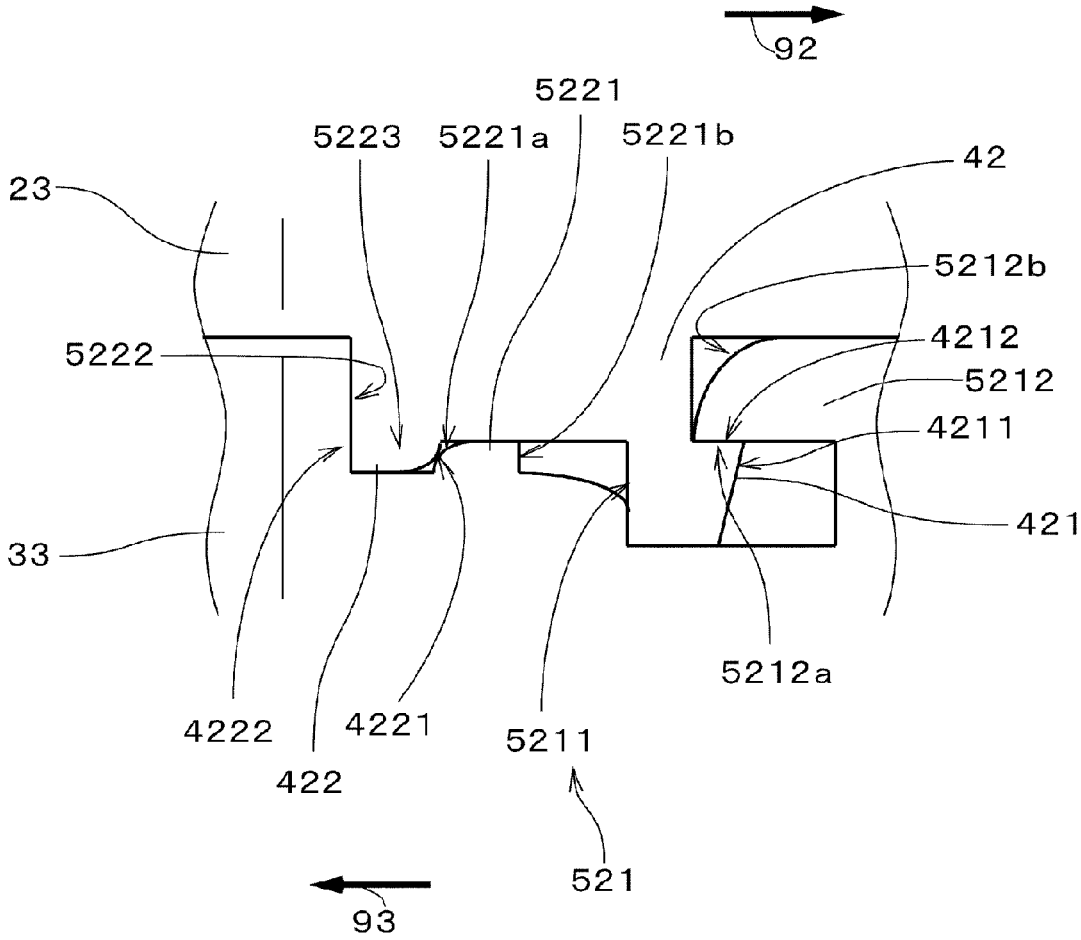
FIG. 7 is an enlarged view showing combination locking portions included in the axial flow fan unit of the first preferred embodiment of the present invention.

FIG. 6 is an enlarged perspective view showing the corner portion 2354 of the first housing 23. FIG. 7 is an enlarged view illustrating the first combination locking portions 42 and the second combination locking portions 52.

As shown in FIG. 6, a third axial locking piece 421 and a first unlocking portion 422 are provided at the lower end of each of the first combination locking portions 42. The third axial locking piece 421 has a substantially uniform cross-section perpendicular or substantially perpendicular to the circumferential direction and protrudes toward the inside of the first housing 23.

As can be seen in FIGS. 6 and 7, the third axial locking piece 421 has a slanting surface 4211 and an upper surface 4212 perpendicular or substantially perpendicular to the axis J1.

As shown in FIG. 6, the first unlocking portion 422 has a substantially uniform cross-section perpendicular or substantially perpendicular to the circumferential direction. The first unlocking portion 422 has a first side surface 4221 as a slanting surface and a second side surface 4222 parallel or substantially parallel to the axis J1.

Figure 8:
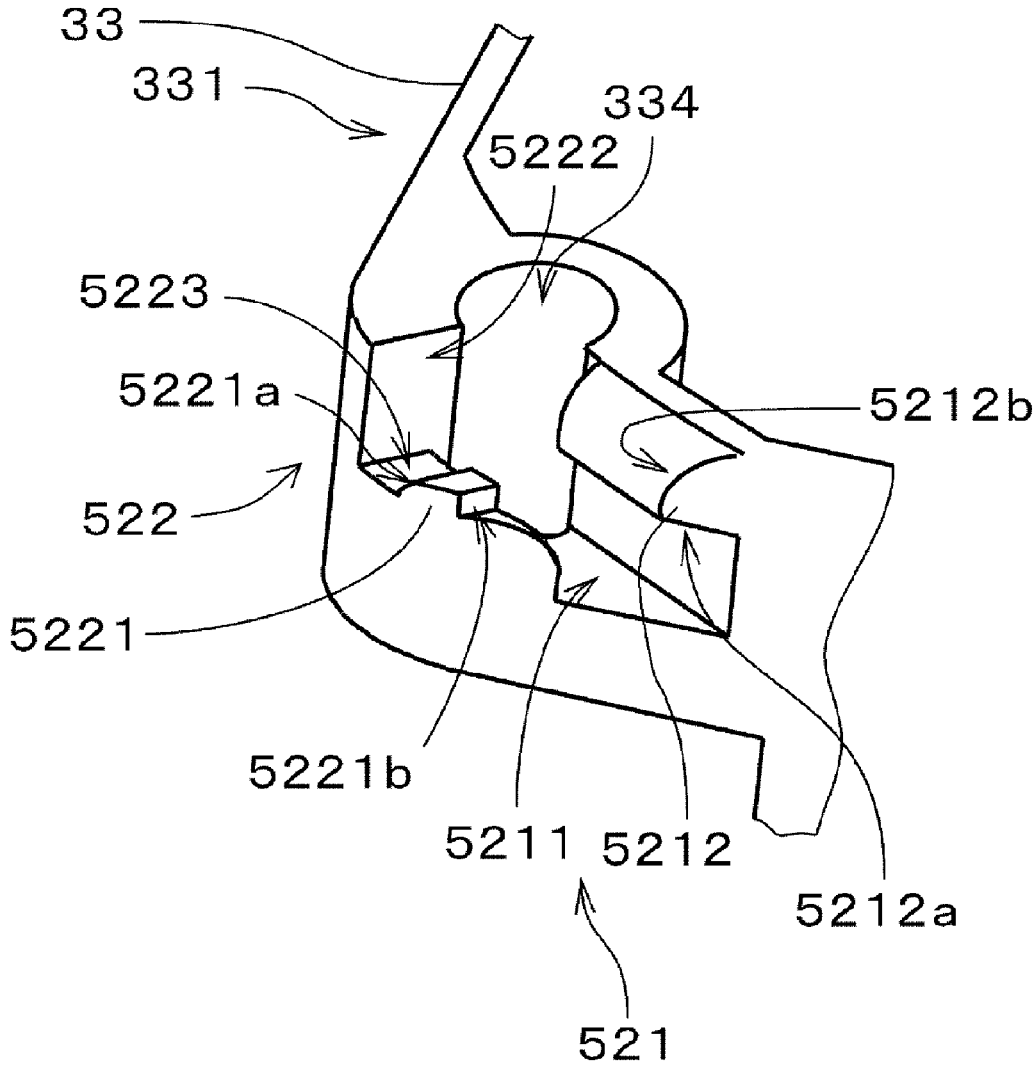
FIG. 8 an enlarged view showing a combination locking portion of the second housing included in the axial flow fan unit of the first preferred embodiment of the present invention.

FIG. 8 is an enlarged perspective view showing the corner portion 3354 of the second housing 33. The second combination locking portion 52 is provided in the corner portion 3354 and has a fourth axial locking portion 521 and a second unlocking portion 522. The second combination locking portions 52 include a groove portion 5211 and a cutout portion 522 and are formed into a recessed shape. The groove portion 5211 extends substantially circumferentially from the through-hole 334 over the outer surface of the flange-like region of the upper end portion 331. The cutout portion 522 is provided adjacent to the groove portion 5211 and the through-hole 334 and has a substantially L-shaped cross-section perpendicular or substantially perpendicular to the radial direction.

Referring to FIGS. 7 and 8, the fourth axial locking piece 5212 of each of the second combination locking portions 52 is positioned above the groove portion 5211 and has a substantially uniform cross-section perpendicular or substantially perpendicular to the circumferential direction. The fourth axial locking piece 5212 has a downwardly facing surface 5212*a* perpendicular or substantially perpendicular to the axis J1 and a slanting surface 5212*b* joining to the downwardly facing surface 5212*a*. The second unlocking portion 5221 is provided in substantially the central region of the bottom surface of the cutout portion 522 and has a substantially uniform cross-section perpendicular or substantially perpendicular to the radial direction.

The second unlocking portion 5221 has a first side surface 5221*a* and a second side surface 5221*b* substantially parallel to the axis J1.

In the corner portions 2354 and 3354, the third axial locking piece 421 of each of the first combination locking portions 42 is inserted into the groove portion 5211 and also locked against the fourth axial locking piece 5212 as can be seen in FIG. 7. This prevents the first housing 23 and the second housing 33 from moving relative to each other along the axis J1.

If the first combination locking portions 42 and the second combination locking portions 52 are locked against each other, the third axial locking piece 421 makes contact with the fourth axial locking piece 5212. This prevents the first housing 23 and the second housing 33 from rotating about the axis J1 in the directions indicated by the arrows 92 and 93. Furthermore, the second side surface 4222 of the first unlocking portion 422 is in contact with the side surface 5222 of each of the second combination locking portions 52. This prevents the first housing 23 and the second housing 33 from rotating about the axis J1 in the directions opposite to the directions indicated by the arrows 92 and 93.

As shown in FIG. 5, the first axial locking portions 41 and the second axial locking portions 51 are locked against each other. This also prevents the first housing 23 and the second housing 33 from rotating in the directions opposite to the directions indicated by the arrows 92 and 93.

As set forth above, the first axial locking portions 41 and the second axial locking portions 51 plus the third axial locking piece 421 and the fourth axial locking piece 5212 provide axial locking structures in the corner portions 2352, 2354, 3352, and 3354.

In addition, the third axial locking piece 421 and the fourth axial locking piece 5212 plus the first unlocking portion 422 and the second side surface 5222 of the cutout portion 522 provide rotation-preventing structures.

In the present preferred embodiment, the first axial locking portions 41 and the second axial locking portions 51, which form a pair, are locked against each other and the first combination locking portions 42 and the second combination locking portions 52, which form a pair, are locked against each other, in all of the corner portions 2351 to 2354 and 3351 to 3354.

With this structure, if the lower end portion 232 of the first housing 23 and the upper end portion 331 of the second housing 33 are brought into contact with each other, the first housing 23 and the second housing 33 are locked against each other and are prevented from being separated from each other in the direction parallel or substantially parallel to the axis J1.

Furthermore, if the first combination locking portions 42 and the second combination locking portions 52 are locked against each other as shown in FIG. 7, the first housing 23 and the second housing 33 are prevented from rotating about the axis J1 in the directions indicated by the arrows 92 and 93 or in the opposite directions. Description will be made below regarding the rotation, i.e., torsion, in the directions indicated by the arrows 92 and 93.

In the manner as noted above, the lower end portion 232 of the first housing 23 and the upper end portion 331 of the second housing 33 are prevented from making relative rotation. Even when a force is applied to rotate the lower end portion 232 and the upper end portion 331 relative to each other about an axis substantially parallel to the axis J1 (an axis other than the axis J1), the relative rotation is also prevented by one or more of the aforementioned locking portions.

Connection of Housings

Figure 9:
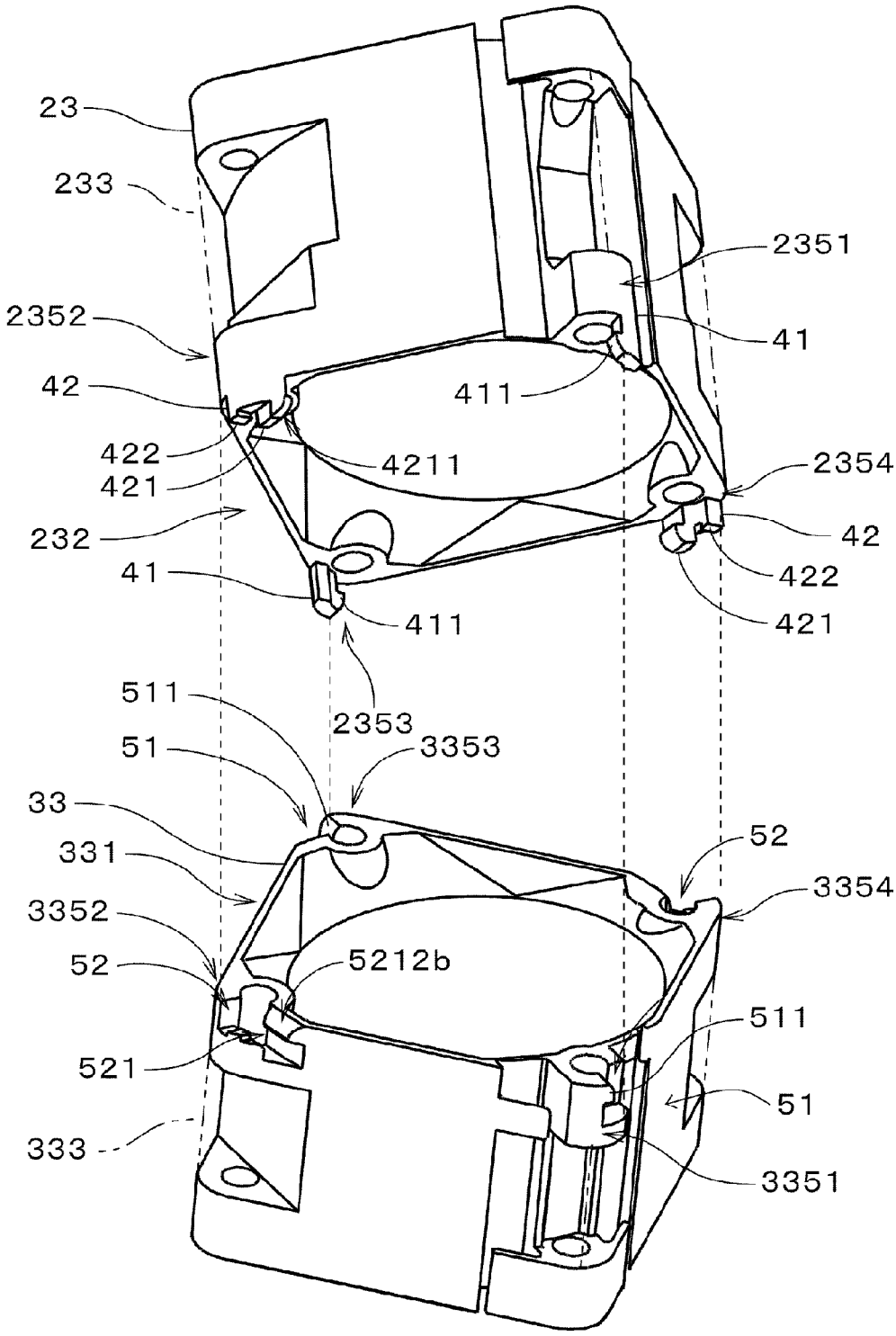
FIG. 9 is an exploded perspective view showing the axial flow fan unit of the first preferred embodiment of the present invention.

FIG. 9 is an exploded perspective view of the axial flow fan unit 1, which shows in what manner the first housing 23 and the second housing 33 are coupled together. The first housing 23 and the second housing 33 independently shown in FIGS. 3 and 4 are illustrated in FIG. 9 in such a state that they are turned around the central axis J1 about 60 degrees (counterclockwise when seen from above).

When coupling the first housing 23 and the second housing 33 together, they are first placed in an opposing relationship so that the contour lines 233 and 333 thereof can be roughly aligned with each other. Then the first housing 23 is caused to axially move toward the second housing 33 until the lower end portion 232 comes into contact with the upper end portion 331.

Figure 10:
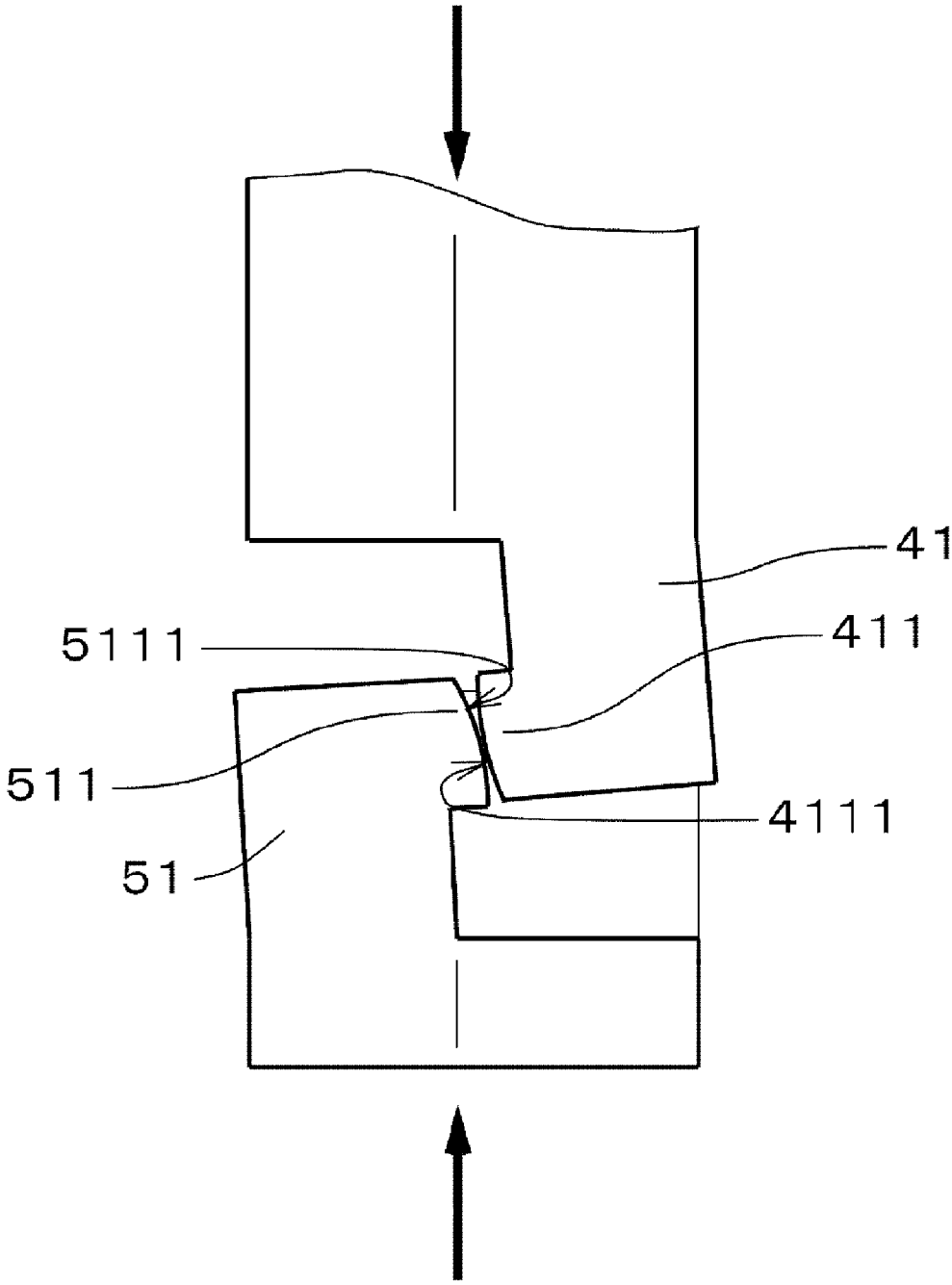
FIG. 10 is a view showing how the axial locking portions are locked together in the axial flow fan unit of the first preferred embodiment of the present invention.

FIG. 10 is an enlarged view showing the first axial locking portion 41 and the second axial locking portion 51. In the manner as shown in FIG. 10, the first and second axial locking portions 41 and 51 are moved toward each other in the directions indicated by arrows. Thus, the slanting surface 4111 of the first axial locking piece 411 and the slanting surface 5111 of the second axial locking piece 511 are slidingly moved relative to each other. As a result, the first and second axial locking pieces 411 and 511 are elastically deformed.

Using the restoration forces of the elastically deformed locking pieces 411 and 511, the first and second axial locking pieces 411 and 511 are locked against each other and the upper surface 4112 and the lower surface 5112 are brought into contact with each other as shown in FIG. 5.

In the locking structure provided by the first and second axial locking portions 41 and 51, provision of the slanting surfaces 4111 and 5111 ensures that no excessive load acts on the first and second axial locking pieces 411 and 511. This protects the first and second axial locking pieces 411 and 511 from damage.

In the locking structure provided by the first and second axial locking portions 41 and 51, the first housing 23 and the second housing 33 are pressed against each other in a mutually twisting rotational direction.

Figure 11:
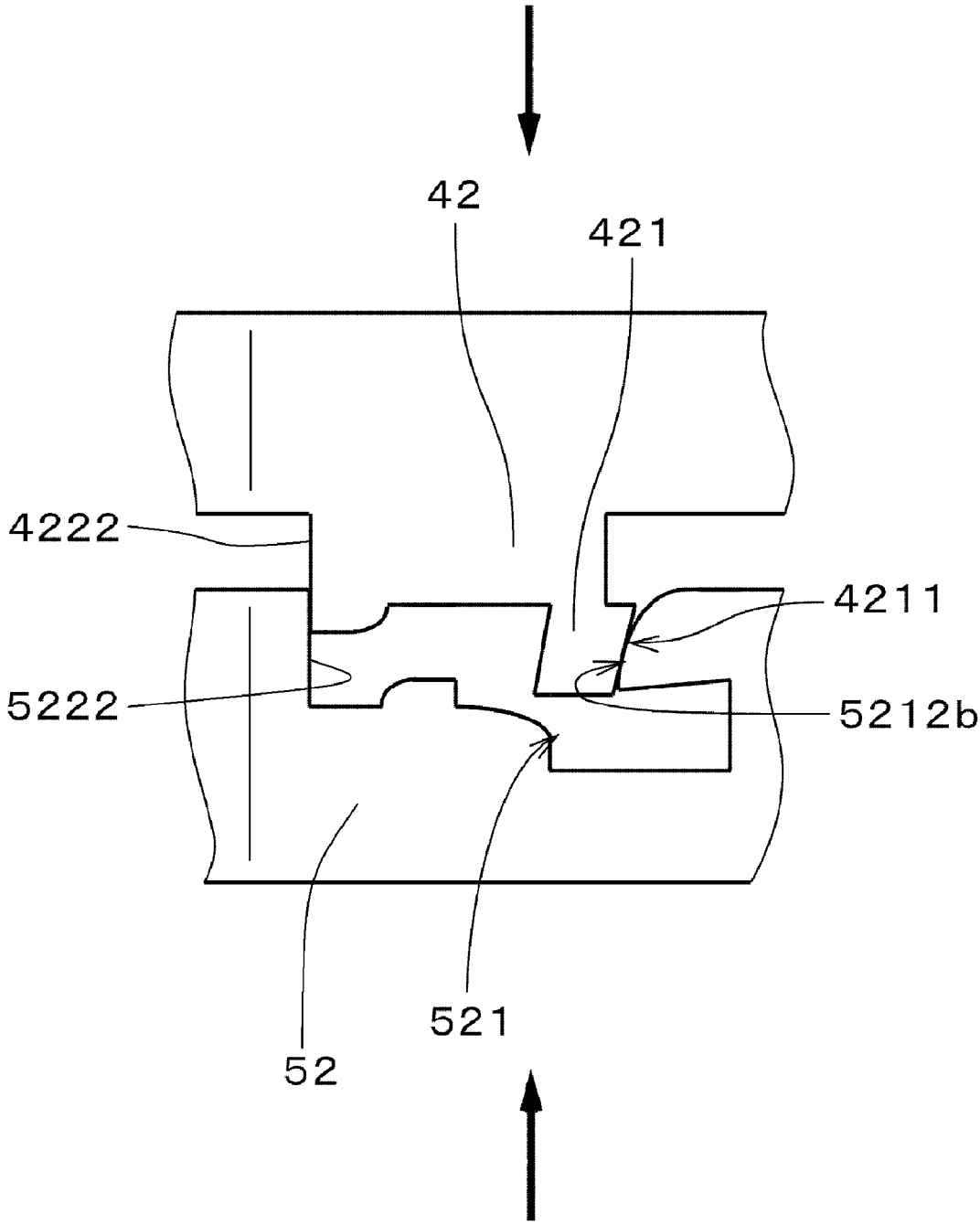
FIG. 11 is an enlarged view showing how the combination locking portions are locked together in the axial flow fan unit of the first preferred embodiment of the present invention.

FIG. 11 is an enlarged view showing the first combination locking portion 42 and the second combination locking portion 52. In the manner as shown in FIG. 11, the first and second combination locking portions 42 and 52 are moved toward each other in the directions indicated by arrows. Thus, the slanting surface 4211 of the third axial locking piece 421 and the slanting surface 5212*b* of the fourth axial locking piece 5212 are slidingly moved relative to each other. As a result, the third and fourth axial locking pieces 421 and 5212 are elastically deformed.

Using the restoration forces of the elastically deformed locking pieces 421 and 5212, the third and fourth axial locking pieces 421 and 5212 are locked against each other and the upper surface 4212 and the lower surface 5212*a* are brought into contact with each other as shown in FIG. 7.

As shown in FIG. 7, the first unlocking portion 422 is fitted to the first unlocking reception portion 5223 as the third and fourth axial locking pieces 421 and 5212 are locked against each other. As a consequence, the first side surface 4221 and the second side surface 4222 of the first unlocking portion 422 make contact with the first side surface 5221*a* and the second side surface 5222 of the first unlocking reception portion 5223, respectively. In other words, the first unlocking portion 422 and the first unlocking reception portion 5223 engage with each other in the circumferential direction. In this regard, the first unlocking reception portion 5223 shares the first side surface 5221*a* with the second unlocking portion 5221.

In the locking structure provided by the first and second combination locking portions 42 and 52, provision of the slanting surfaces 4211 and 5212*b* ensures that no excessive load acts on the first unlocking portion 422 and the first unlocking reception portion 5223. This protects the first and second combination locking portions 42 and 52 from damage which would otherwise be caused during the locking process.

Through the coupling work set forth above, the first housing 23 and the second housing 33 are fixed relative to each other in all of the corner portions 2351 to 2354 and 3351 to 3354 thereof.

In this connection, the opposite end portions of the first housing 23 and the second housing 33 preferably have a substantially square contour. This leads to a likelihood that the corner portions of the first housing 23 may be attempted to be coupled to those of the second housing 33 in a combination other than the specified combination.

For example, there may be an instance that the first axial locking portions 41 are erroneously mated with the second combination locking portions 52, with the first combination locking portions 42 mated with the second axial locking portions 51. Even if such an instance occurs, it is impossible to couple the first housing 23 and the second housing 33 together because the erroneously mated locking portions differ in their structure. Accordingly, use of the housing coupling structure of this preferred embodiment makes it possible to prevent incorrect coupling of the first housing 23 and the second housing 33.

Even if the first housing 23 and the second housing 33 are twistingly rotated after they make contact with each other, it is equally impossible to couple them together. Therefore, the first housing 23 and the second housing 33 can be coupled together only when they are moved in the axial direction. This holds true in other preferred embodiments to be described below.

Separation of Housings

Next, description will be made of the task of separating the first housing 23 and the second housing 33 from each other. As shown in FIG. 1, relative rotating forces (i.e., twisting forces) are applied to the first housing 23 and the second housing 33 in the directions indicated by the arrows 92 and 93. Thus the first side surface 4221 of the first unlocking portion 422 and the first side surface 5221*a* of the second unlocking portion 5221 are pressed against each other in the corner portions 2352 and 2354 of the first housing 23 and the corner portions 3352 and 3354 of the second housing 33.

If the twisting force applied at this time becomes equal to or greater than a predetermined value, the first unlocking portion 422 and the second unlocking portion 5221 are slidingly moved relative to each other, thereby generating a force that urges the first housing 23 and the second housing 33 to move away from each other. As a result, the first unlocking portion 422 is disengaged from the first unlocking reception portion 5223 and, simultaneously, the third locking piece 421 and the fourth axial locking piece 5212 rotate with respect to one another so as to slidingly disengage the lock therebetween. Now, it is to be appreciated that the "twisting force" is a force large enough to securely retain the elements in the axial flow fan 1 while the fan is in operation wherein the first unlocking portion 422 and the second unlocking portion 5221 are allowed to slide with respect to one another in a relative manner. Also note that the "predetermined value" of the twisting force is to be determined in accordance with the dimensions and shapes of the first unlocking portion 422, the second unlocking portion 5221, the first side surfaces 4221 and 5221*a*. Furthermore, the predetermined value of the twisting force may be modified in accordance with the material used to make the housing.

The first axial locking piece 411 and the second axial locking piece 511 are moved away from each other in each of the corner portions 2351, 2353, 3351, and 3353.

In the manner as set forth above, the locking portions of the axial flow fan unit 1 are unlocked in all of the corner portions 2351 to 2354 and 3351 to 3354 so that the first housing 23 and the second housing 33 can be separated from each other.

In the process of fabricating the axial flow fan unit 1, use of the corner portions 2351 to 2354 and 3351 to 3354 as identification markers makes it possible to easily align the contour lines 233 and 333 of the first housing 23 and the second housing 33 in the axial direction. This makes it easy to arrange the first housing 23 and the second housing 33 and to couple them together. Furthermore, the first housing 23 and the second housing 33 can be easily separated from each other by twisting them in a specified direction with a twisting force equal to or greater than a predetermined value.

As stated above, the direction in which a force is applied to couple the first housing 23 and the second housing 33 together (i.e., the direction of the axis J1) differs from the direction in which a force is applied to separate the first housing 23 and the second housing 33 from each other (i.e., the twisting direction about the axis J1). This makes it hard to make operational errors when coupling and separating the first housing 23 and the second housing 33. In addition, it becomes easy to design a structure that prevents the first housing 23 and the second housing 33 from being damaged when coupling and separating them.

Due to this feature, if a number of second axial flow fans with second impellers slightly differing from one another are prepared in advance, it is possible to readily change the combination of the first axial flow fan 2 and the second axial flow fan 3 when coupling them together. This makes it easy to perform the task of finding a second axial flow fan that conforms to the first axial flow fan 2. Consequently, it is possible to reduce vibration or noises generated in the axial flow fan unit 1.

Since the axial flow fan unit 1 does not permit easy separation, it is possible to prevent inadvertent separation of the axial flow fan unit 1 in the process of fabricating the same. By "inadvertent separation", it is meant that the frame is inadvertently separated by, e.g., the hands of a worker touching the frame.

Due to the fact that the first unlocking portion 422 preferably is provided in each of the first combination locking portions 42 of the corner portions 2352 and 2354, it is possible to increase the degree of freedom in designing the corner portions 2351 and 2353. Alternatively, it may be possible to omit the first axial locking piece 411 from each of the corner portions 2351 and 2353 of the first housing 23.

Second Preferred Embodiment

Figure 12:
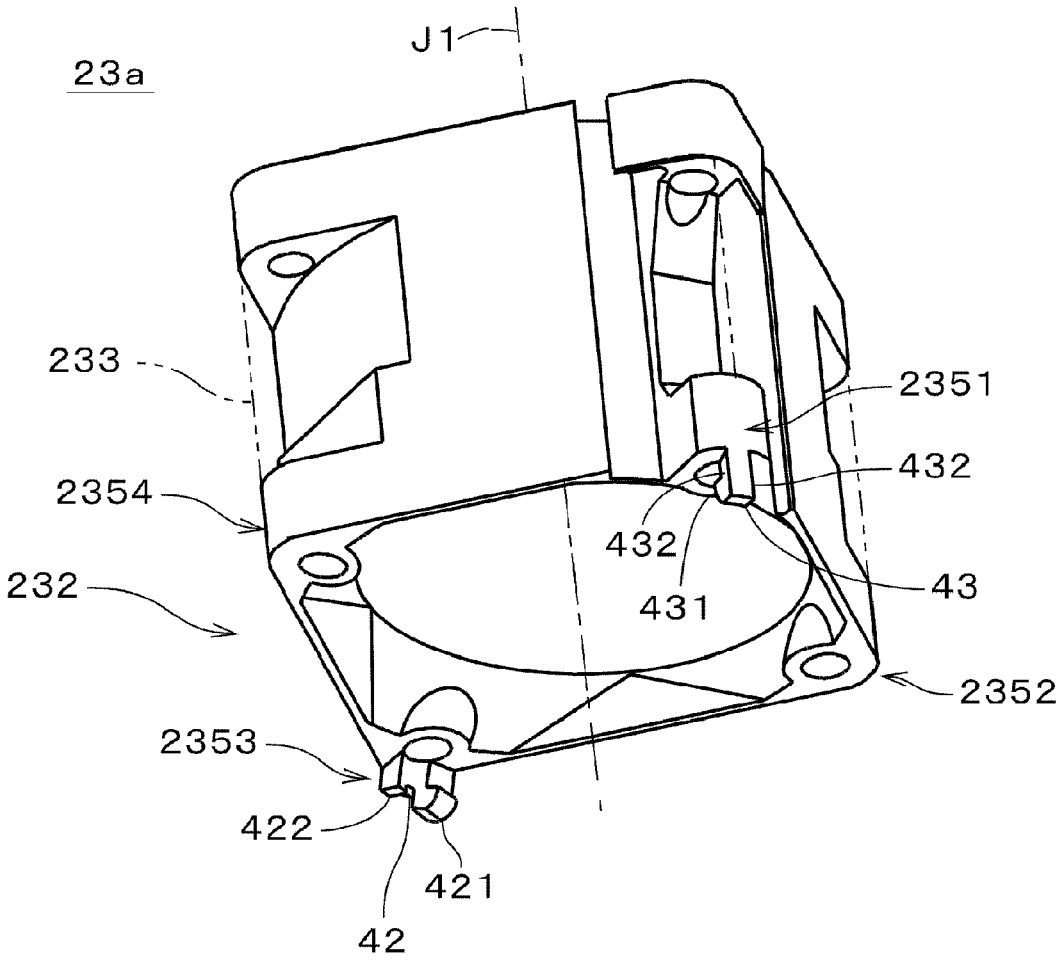
FIG. 12 is a perspective view showing a first housing of an axial flow fan unit in accordance with a second preferred embodiment of the present invention.

The second preferred embodiment differs from the first preferred embodiment in terms of the structure of the axial locking portions. FIG. 12 is a perspective view showing a first housing 23*a* of the first axial flow fan 2 employed in an axial flow fan unit of the second preferred embodiment. In the corner portions 2351 and 2353 of the lower end portion 232 of the first housing 23*a*, there are provided a first combination locking portion 42 and a fifth axial locking portion 43, both of which protrude toward the upper end portion 331 of the second housing 33 and extend along the contour lines 233 of the first housing 23*a*.

Figure 13:
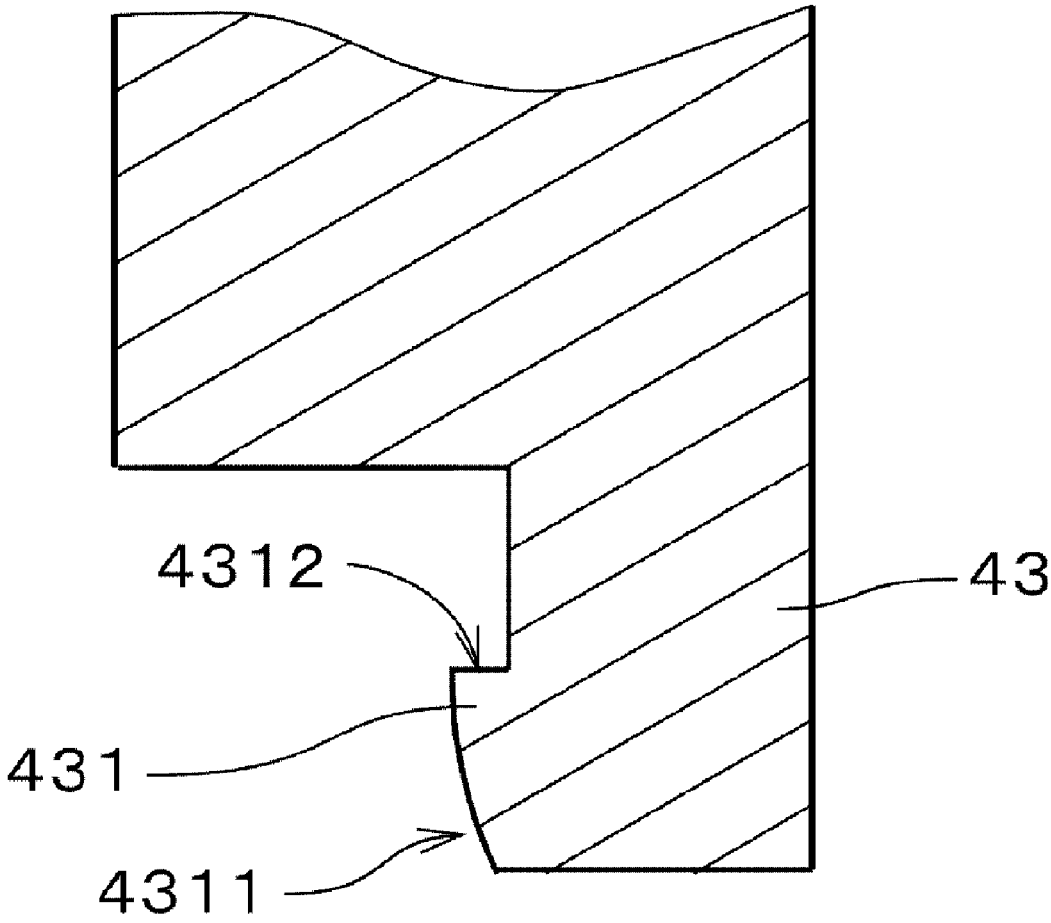
FIG. 13 is a section view showing an axial locking portion of the first housing included in the axial flow fan unit of the second preferred embodiment of the present invention.

FIG. 13 is a section view of the fifth axial locking portion 43 of the corner portion 2351 taken along a plane perpendicular to the circumferential direction in FIG. 12. In the fifth axial locking portion 43, there is provided a fifth axial locking piece 431 as a protrusion portion protruding radially inwards (toward the left side in FIG. 13). The fifth axial locking piece 431 has a slanting surface 4311 inclined upwards and radially inwards and an upper surface 4312 perpendicular or substantially perpendicular to the axis J1.

Figure 14:
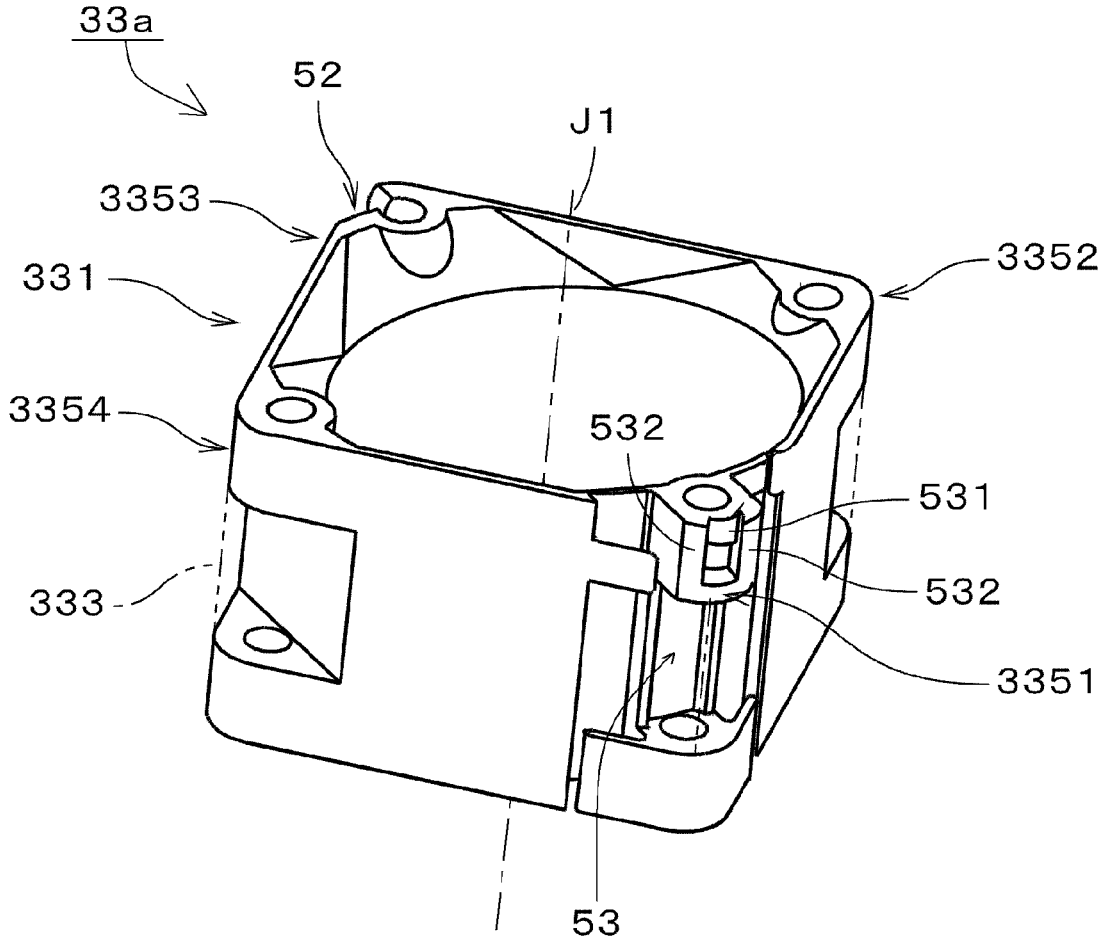
FIG. 14 is a perspective view showing a second housing of the axial flow fan unit of the second preferred embodiment of the present invention.

FIG. 14 is a perspective view showing a second housing 33*a* of the second axial flow fan 3. In the corner portions 3351 and 3353 of the upper end portion 331 of the second housing 33*a*, there are provided a second combination locking portion 52 having a cutout shape and a sixth axial locking portion 53, both of which extend along the contour lines 333 of the second housing 33*a*.

Figure 15:
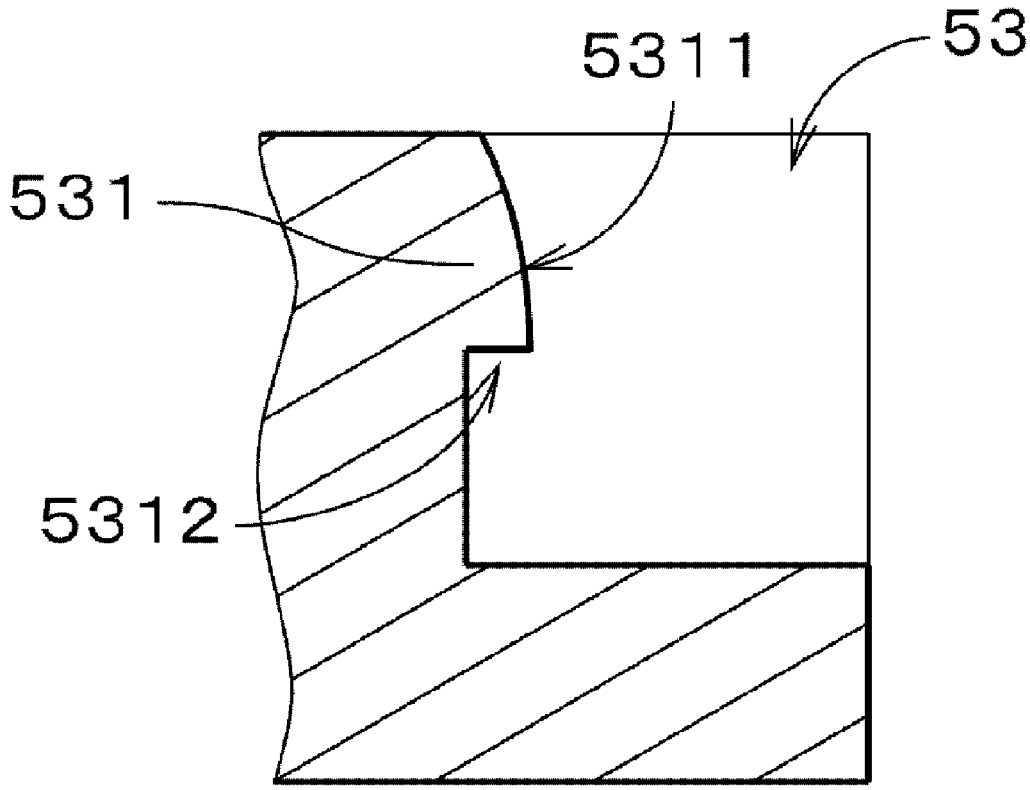
FIG. 15 is a section view showing an axial locking portion of the second housing included in the axial flow fan unit of the second preferred embodiment of the present invention.

FIG. 15 is a section view of the sixth axial locking portion 53 of the corner portion 3351 taken along a plane perpendicular to the circumferential direction in FIG. 14. Within the sixth axial locking portion 53, there is provided a sixth axial locking piece 531 protruding to the right side in FIG. 15. The sixth axial locking piece 531 has a slanting surface 5311 and a lower surface 5312 perpendicular or substantially perpendicular to the axis J1.

When the first housing 23*a* and the second housing 33*a* shown in FIGS. 13 and 15 are in a coupled state, the fifth axial locking piece 431 and the sixth axial locking piece 531 are locked against each other and the upper surface 4312 and the lower surface 5312 are brought into contact with each other. Thus the lower end portion 232 and the upper end portion 331 are locked against relative movement along the axis J1.

At the same time, the opposite side surfaces 432 and 432 of the fifth axial locking piece 431 come into contact with the opposite side surfaces 532 and 532 of the sixth axial locking portion 53. The fifth axial locking portion 43 and the sixth axial locking portion 53 also perform an anti-rotation function.

As can be seen in FIG. 12, the first combination locking portion 42 of the corner portion 2353 is structurally the same as the first combination locking portion employed in the first preferred embodiment.

The second combination locking portion 52 shown in FIG. 14 is structurally the same as the second combination locking portion employed in the first preferred embodiment. For that reason, no description will be made of the structure and locking operation of these combination locking portions.

Use of the aforementioned structure in the second preferred embodiment prevents the lower end portion 232 and the upper end portion 331 from being axially separated from each other as is the case in the first preferred embodiment. This also prevents the first housing 23*a* and the second housing 33*a* from rotating relative to each other about the axis J1.

In order to couple the first housing 23*a* and the second housing 33*a* together, they are arranged in an opposing relationship while bringing the contour lines 233 of the first housing 23*a* into alignment along the axis J1. Then the first housing 23*a* and the second housing 33*a* are moved toward each other in a direction substantially parallel to the axis J1, thereby bringing the lower end portion 232 and the upper end portion 331 into contact with each other.

At this time, the slanting surface 4311 of the fifth axial locking piece 431 is slidingly moved relative to the slanting surface 5311 of the sixth axial locking piece 531 in the corner portions 2351 and 3351. This causes the fifth axial locking piece 431 to be elastically deformed. Then the fifth axial locking piece 431 is locked against the sixth axial locking piece 531 by the restoration force thereof. Simultaneously, the opposite side surfaces 432 and 432 of the fifth axial locking piece 431 make contact with the opposite side surfaces 532 and 532 of the sixth axial locking piece 531 in the circumferential direction about the axis J1 (see FIGS. 13 and 15).

In the corner portions 2353 and 3353, the slanting surface 4211 of the third axial locking piece 421 is slidingly moved relative to the slanting surface 5212*b* of the fourth locking piece 5212. This causes the third axial locking piece 421 to be elastically deformed (see FIG. 11). Then the third axial locking piece 421 and the fourth locking piece 5212 are locked against each other. The first unlocking portion 422 is inserted into the first unlocking reception portion 5223 so that the first and second side surfaces 4221 and 4222 of the first unlocking portion 422 can make contact with the first and second side surfaces 5221*a* and 5222 of the first unlocking reception portion 5223.

Through the coupling operation set forth above, the corner portions 2351 and 2353 of the first housing 23*a* are opposite the corner portions 3351 and 3353 of the second housing 33*a*, and the first housing 23*a* is fixed relative to the second housing 33*a*.

In the second preferred embodiment, the corner portions are prevented from being mated in a combination other than the specified combination as is the case in the first preferred embodiment. Likewise, the first housing 23*a* and the second housing 33*a* cannot be coupled together by rotating them. Only the axial movement permits coupling of the first housing 23*a* and the second housing 33*a*.

In order to separate the first housing 23*a* and the second housing 33*a* from each other, a twisting force, which is equal to or greater than a predetermined value and acts about an axis substantially parallel to the axis J1, may be applied to the first housing 23*a* and the second housing 33*a* through the corner portions 2351 and 3351.

The combination locking portions of the corner portions 2353 and 3353 are unlocked in the same manner as the unlocking portions of the combination locking portions employed in the first preferred embodiment. As a result, the corner portions 2353 and 3353 are unlocked and to be separated from each other. Thus, it is possible to unlock the fifth axial locking portion 43 and the sixth axial locking portion 53 with ease.

Use of the aforementioned structure in the second preferred embodiment makes it possible to readily couple the first housing 23*a* and the second housing 33*a* together merely by axially aligning them and bringing them into contact with each other. Furthermore, the first housing 23*a* and the second housing 33*a* can be easily separated from each other with a twisting force equal to or greater than a predetermined value.

The coupling direction of the first housing 23*a* and the second housing 33*a* is different than the separating direction thereof. This makes it possible to easily couple and separate the first housing 23*a* and the second housing 33*a* without causing damage thereto.

Third Preferred Embodiment

The third preferred embodiment is directed to an axial flow fan unit in which two axial locking portions having different structures are employed.

Figure 16:
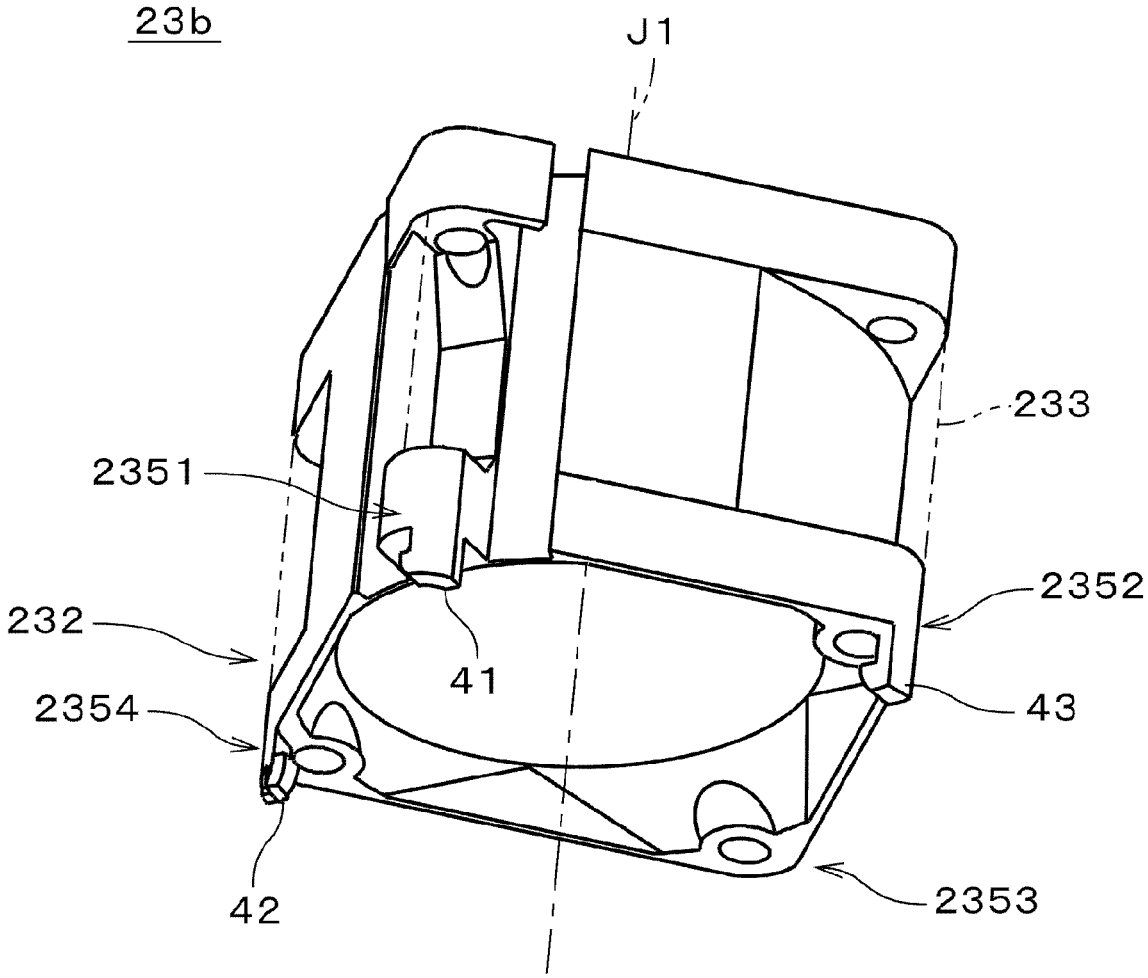
FIG. 16 is a perspective view showing a first housing of an axial flow fan unit in accordance with a third preferred embodiment of the present invention.
Figure 17:
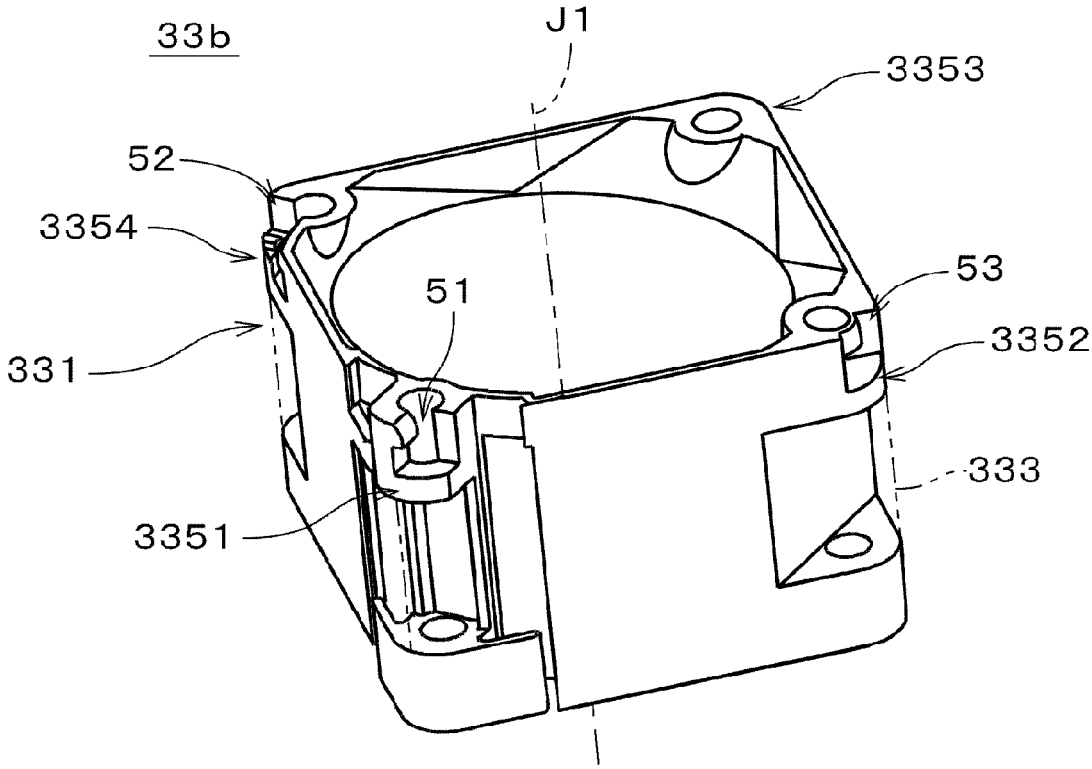
FIG. 17 is a perspective view showing a second housing included in the axial flow fan unit of the third preferred embodiment of the present invention.

FIG. 16 is a perspective view showing a first housing 23*b* employed in the axial flow fan unit of the third preferred embodiment. FIG. 17 is a perspective view showing a second housing 33*b* of second axial flow fan 3.

In the corner portions 2351, 2352, and 2354 of the lower end portion 232 of the first housing 23*b*, there are provided a first axial locking portion 41, a fifth axial locking portion 43, and a first combination locking portion 42, respectively.

In the corner portions 3351, 3352, and 3354 of the upper end portion 331 of the second housing 33*b*, there are provided a second axial locking portion 51, a sixth axial locking portion 53, and a second combination locking portion 52, respectively.

With the third preferred embodiment, the locking portions mating with each other are locked in the three corner portions 2351, 2352, and 2354 of the first housing 23*b* and in the three corner portions 3351, 3352, and 3354 of the second housing 33*b*. Thus the first housing 23*b* and the second housing 33*b* are coupled together along the axis J1.

Relative rotation of the first housing 23*b* and the second housing 33*b* is prevented in the corner portions 2352 and 2354 of the first housing 23*b* and in the corner portions 3352 and 3354 of the second housing 33*b*.

The first housing 23*b* and the second housing 33*b* are preferably coupled together by the same method as used in the preceding preferred embodiments.

Just like the method used in the preceding preferred embodiments, the first housing 23*b* and the second housing 33*b* may be separated from each other by applying thereto a twisting force equal to or greater than a predetermined value.

The combination locking portions have an axial locking function and an axial unlocking function and are capable of preventing relative rotation of the first housing 23*b* and the second housing 33*b*. This makes it possible to increase the degree of freedom in designing the locking portions other than the combination locking portions.

Fourth Preferred Embodiment

The fourth preferred embodiment is directed to an axial flow fan unit in which the axial locking portions and the axial unlocking portions are provided independently of each other.

Figure 18:
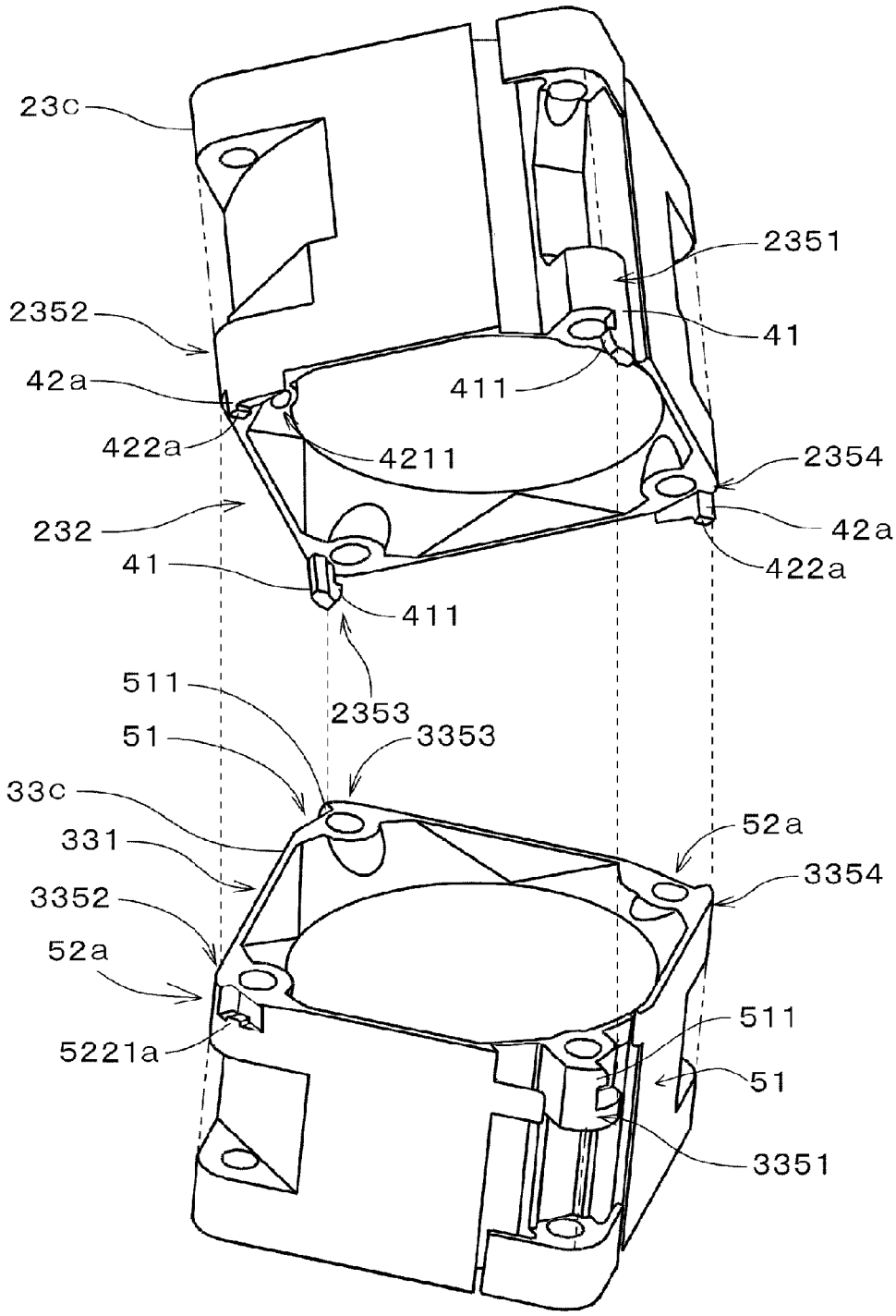
FIG. 18 is an exploded perspective view showing a serially connected axial flow fan unit in accordance with a fourth preferred embodiment of the present invention.

FIG. 18 is an exploded perspective view showing the axial flow fan unit in accordance with the fourth preferred embodiment, which view illustrates in what manner a first housing 23*c* and a second housing 33*c* are coupled together.

Figure 19:
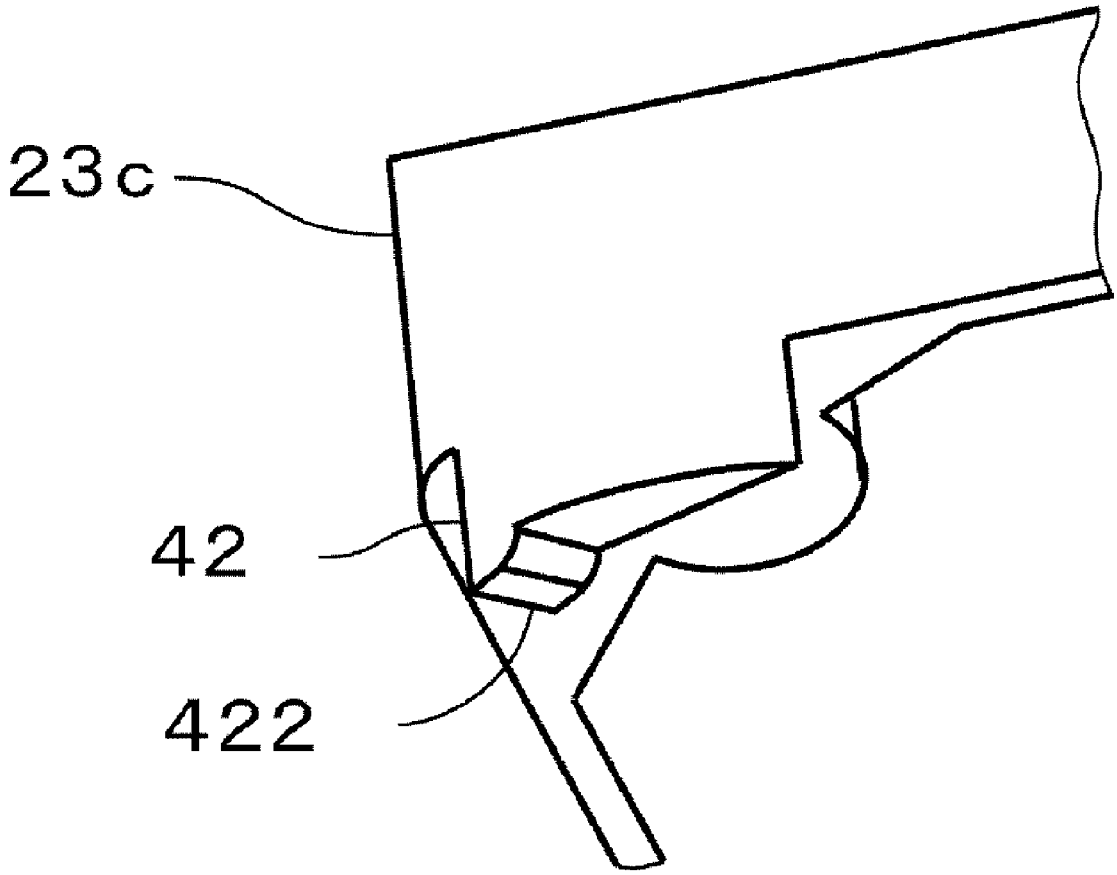
FIG. 19 is an enlarged view showing a third unlocking portion of a first housing included in the axial flow fan unit of the fourth preferred embodiment of the present invention.

FIG. 19 is an enlarged view showing one corner portion 2352 of the first housing 23*c* employed in the axial flow fan unit of the fourth preferred embodiment.

Figure 20:
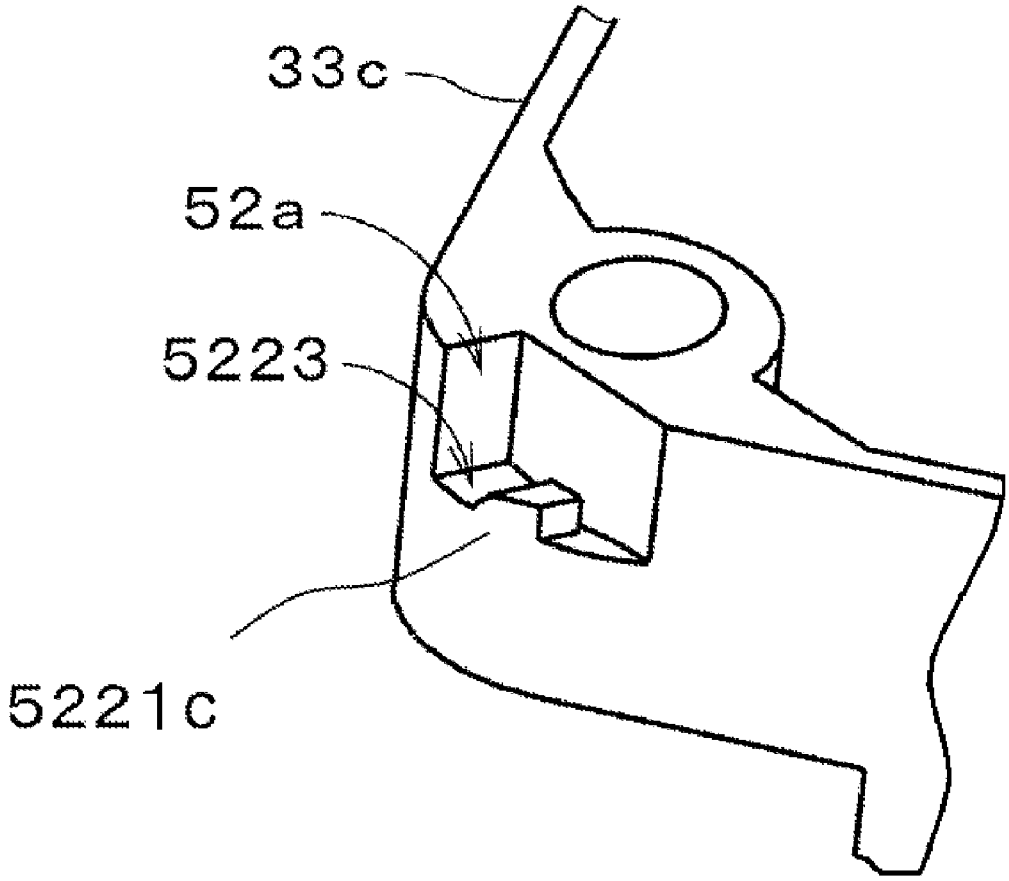
FIG. 20 is an enlarged view showing a fourth unlocking portion of a second housing included in the axial flow fan unit of the fourth preferred embodiment of the present invention.

FIG. 20 is an enlarged view showing the corner portion 3352 of the second housing 33*c* corresponding to the corner portion 2352 of the first housing 23*c*.

As can be seen in FIG. 18, the first housing 23*c* has third unlocking portions 42*a* provided in the corner portions 2352 and 2354, respectively. First axial locking portions 41 are provided in the corner portions 2351 and 2353, respectively.

The second housing 33*c* has fourth unlocking portions 52*a* provided in the corner portions 3352 and 3354, respectively. Second axial locking portions 51 are provided in the corner portions 3351 and 3353, respectively.

Referring to FIG. 19, each of the third unlocking portions 42*a* employed in the fourth preferred embodiment is provided with a protrusion 422*a* for an unlocking use. Just like the first unlocking portion 422 of the first preferred embodiment, the protrusion 422*a* has a first side surface as a slanting surface and a second side surface.

Turning to FIG. 20, each of the fourth unlocking portions 52*a* employed in the fourth preferred embodiment is provided with a protrusion 5221*c* for an unlocking use. Just like the second unlocking portion 5221 of the first preferred embodiment, the protrusion 5221*c* has a first side surface as a slanting surface and a second side surface.

Second axial locking portions 51, which have the same configuration as those of the first preferred embodiment, are provided in the corner portions 3351 and 3353 of the second housing 33*c*.

With the fourth preferred embodiment, the locking portions mating with each other are locked in the same manner as in the preceding preferred embodiments, thereby coupling the first housing 23*c* and the second housing 33*c* together along the axis J1.

In the fourth preferred embodiment, the tasks of coupling and separating the first housing 23*c* and the second housing 33*c* are the same as those of the first preferred embodiment. This means that the first housing 23*c* and the second housing 33*c* can be coupled and separated with ease.

Other Preferred Embodiments

While certain preferred embodiments of the present invention have been described hereinabove, the present invention is not limited these preferred embodiments but may be modified or changed in many different forms. For example, in the first preferred embodiment, two first axial locking portions 41 differing in axial length from each other may be provided in the corner portions 2351 and 2353 of the first housing 23 as shown in FIG. 21.

In this case, two second axial locking portions 51 differing in vertical length from each other are provided in the corner portions 3351 and 3353 of the second housing 33 (see FIG. 4) corresponding to the corner portions 2351 and 2353 of the first housing 23.

Figure 21:
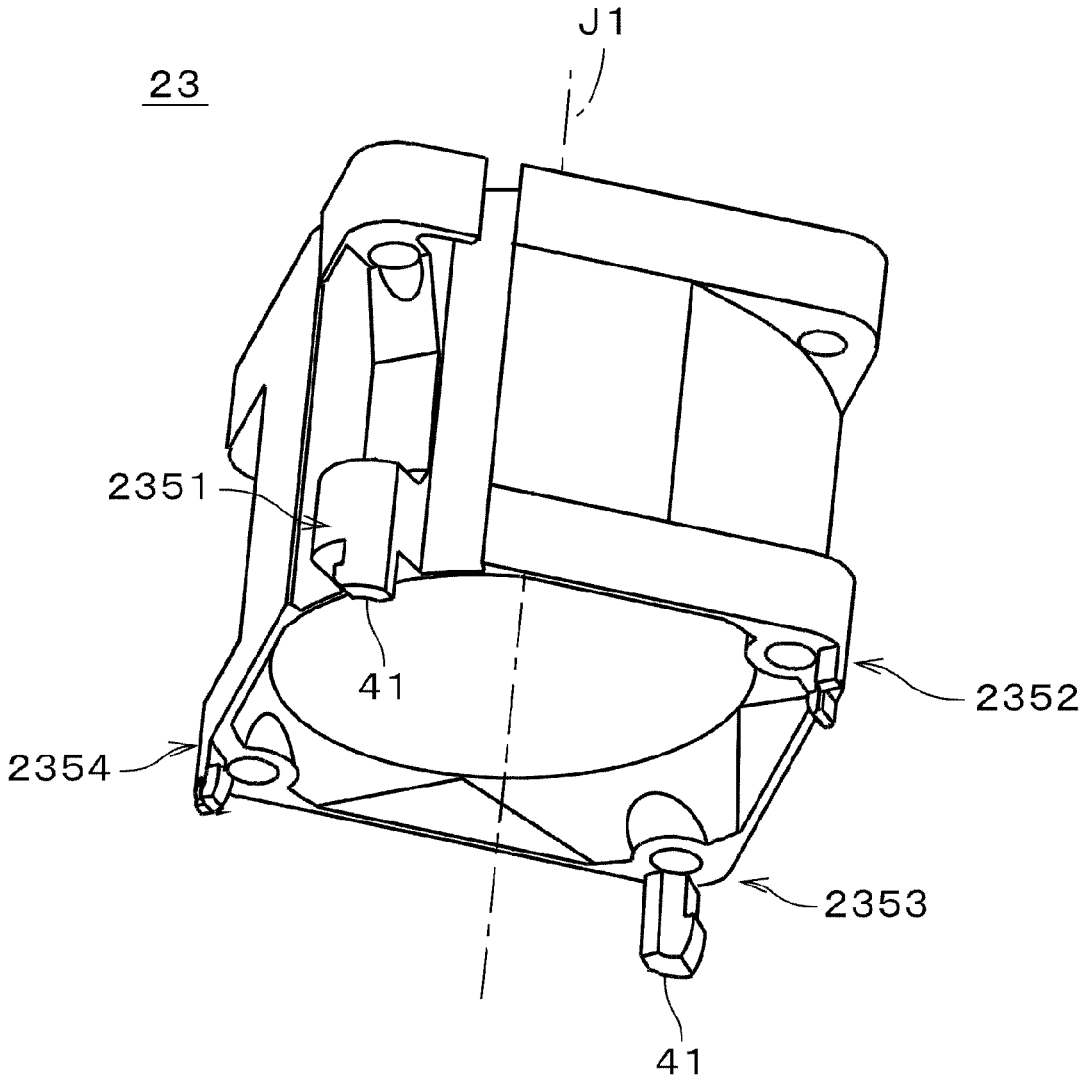
FIG. 21 is a perspective view showing a modified example of the first housing included in the axial flow fan unit of the first preferred embodiment of the present invention.

With the first housing 23 shown in FIG. 21, the corner portion 2353 (or the corner portion 2351) has a shape differing from the shape of any one of the remaining three corner portions 2351, 2352, and 2354 (or the corner portions 2352, 2353, and 2354). This eliminates the possibility that the first housing 23 and the second housing 33 are coupled together in the wrong direction during the course of fabricating the axial flow fan unit. In the first preferred embodiment, all of the locking portions protruding from the corner portions 2351 to 2354 of the first housing 23 may differ in shape from one another.

In the second preferred embodiment, the third axial locking portion 43 of the corner portion 2351 of the first housing 23*a* shown in FIG. 12 may be changed to the first combination locking portion 42.

Furthermore, the third axial locking portion 53 of the corner portion 3351 of the second housing 33*a* shown in FIG. 14 may be changed to the second combination locking portion 52.

In the preferred embodiments described hereinabove, there are illustrated instances where preferably the same kinds of locking portions are provided in the diagonal positions with respect to the axis J1. However, the present invention is not limited thereto. In the axial flow fan unit of the present invention, the same kinds of locking portions may be provided in two neighboring corner portions.

In the first, second, and third preferred embodiments set forth above, the combination locking portion may preferably be provided only in a single corner portion. This increases the degree of freedom in designing the remaining corner portions.

In the axial flow fan unit shown in FIG. 2, the ribs 24 and 34 for fixing the motor units 22 and 32 in place may preferably be provided at the exhaust side. The structure for coupling the first axial flow fan 2 and the second axial flow fan 3 together may well be employed in a serially connected axial flow fan unit including three or more axial flow fans. The contour of the first and second housings may have a substantially cylindrical columnar shape or a polygonal columnar shape as well as a substantially square columnar shape.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A frame for a serially connected axial flow fan unit, the frame comprising:

a first housing and a second housing coupled together;

the first housing including at a first end portion thereof a first axial locking mechanism and a first unlocking mechanism; and the second housing including at a second end portion thereof a second axial locking mechanism arranged to engage with the first axial locking mechanism and a second unlocking mechanism arranged to engage with the first unlocking mechanism; wherein the first axial locking mechanism and the second axial locking mechanism are configured to be locked against each other through their movement along an axis of the frame;

the first unlocking mechanism and the second unlocking mechanism are configured to unlock the first housing and the second housing with a twisting force equal to or greater than a predetermined value when the first housing and the second housing are twisted relative to each other in a specified direction; and when the first end portion and the second end portion are brought into contact with each other, the first axial locking mechanism and the second axial locking mechanism are locked against each other and the first unlocking mechanism and the second unlocking mechanism engage with each other.

2. The frame of claim 1, wherein the first housing further includes at the first end portion thereof a first combination locking portion having the first axial locking mechanism and the first unlocking mechanism;

the second housing further includes at the second end portion thereof a second combination locking portion having the second axial locking mechanism and the second unlocking mechanism;

the first combination locking portion and the second combination locking portion are configured to be locked against each other through their movement along the axis of the frame and also to unlock the first housing and the second housing with a twisting force equal to or greater than the predetermined value when the first housing and the second housing are twisted relative to each other in a specified direction; and the first combination locking portion and the second combination locking portion are locked against each other when the first end portion and the second end portion are brought into contact with each other.

3. The frame of claim 2, wherein the first housing further includes at the first end portion thereof a first axial locking portion;

the second housing further includes at the second end portion thereof a second axial locking portion;

the first axial locking portion and the second axial locking portion are configured to be locked against each other through their movement along the axis of the frame;

the first axial locking portion and the second axial locking portion are locked against each other when the first end portion and the second end portion are brought into contact with each other; and the first housing and the second housing are configured to be unlocked with a force which is equal to or greater than the predetermined value and acts in a first twisting direction about the axis.

4. The frame of claim 3, wherein the first axial locking portion has at least one of a slanting surface and a surface parallel or substantially parallel to the first end portion; and the second axial locking portion includes a cutout portion having at least one of a recess portion and a raised portion.

5. The frame of claim 3, wherein the first axial locking portion includes a plurality of axial locking portions differing in shape from each other.

6. The frame of claim 3, wherein the first axial locking portion is provided at each of a plurality of corner portions of the first end portion; and the second axial locking portion is provided at each of a plurality of corner portions of the second end portion.

7. The frame of claim 6, wherein at least two of the corner portions of the first end portion are opposite each other with respect to the axis; and at least two of the corner portions of the second end portion are opposite each other with respect to the axis.

8. The frame of claim 3, wherein the first axial locking portion is arranged to extend along a contour of the first housing, and the second axial locking portion is arranged to extend along a contour of the second housing.

9. The frame of claim 3, wherein each of the first axial locking portion and the second axial locking portion has a substantially uniform axial cross-section.

10. The frame of claim 1, wherein the first unlocking mechanism and the second unlocking mechanism are configured to prevent the first housing and the second housing from rotating in a first twisting direction when a force smaller than the predetermined value acts about the axis in the first twisting direction.

11. The frame of claim 1, wherein the first housing and the second housing each have a substantially square columnar shape.

12. The frame of claim 1, wherein the first axial locking mechanism is arranged at the first end portion to have a raised shape and the second axial locking mechanism is arranged at the second end portion to have a recessed shape.

13. The frame of claim 12, wherein the first axial locking mechanism is elastically deformable.

14. The frame of claim 1, wherein the first axial locking mechanism is provided at each of a plurality of corner portions of the first end portion; and the second axial locking mechanism is provided at each of a plurality of corner portions of the second end portion.

15. The frame of claim 14, wherein at least two of the corner portions of the first end portion are opposite each other with respect to the axis; and at least two of the corner portions of the second end portion are opposite each other with respect to the axis.

16. The frame of claim 1, wherein the first unlocking mechanism is arranged at the first end portion to have a raised shape; and the second unlocking mechanism is arranged at the second end portion to have a recessed shape.

17. The frame of claim 16, wherein the first unlocking mechanism is elastically deformable.

18. The frame of claim 1, wherein the first housing and the second housing are made of an injection-molded resin.

19. A serially connected axial flow fan unit, comprising:

a first axial flow fan including a first impeller and a first housing; and a second axial flow fan including a second impeller and a second housing;

the first housing including at a first end portion thereof a first axial locking mechanism and a first unlocking mechanism; and the second housing including at a second end portion thereof a second axial locking mechanism arranged to engage with the first axial locking mechanism and a second unlocking mechanism arranged to engage with the first unlocking mechanism; wherein the first axial locking mechanism and the second axial locking mechanism are configured to be locked against each other through their movement along an axis of the axial flow fan unit;

the first unlocking mechanism and the second unlocking mechanism are configured to unlock the first housing and the second housing with a twisting force equal to or greater than a predetermined value when the first housing and the second housing are twisted relative to each other in a specified direction; and when the first end portion and the second end portion are brought into contact with each other, the first axial locking mechanism and the second axial locking mechanism are locked against each other and the first unlocking mechanism and the second unlocking mechanism engage with each other.

20. The axial flow fan unit of claim 19, wherein the first impeller and the second impeller are arranged to rotate in opposite directions.

* * * * *